US010172484B2

(12) United States Patent
Maldonado

(10) Patent No.: US 10,172,484 B2
(45) Date of Patent: Jan. 8, 2019

(54) STACKABLE/WALL MOUNTABLE HEADWEAR STORAGE AND DISPLAY CABINET SYSTEM WITH VARIABLE LIGHTING (CAPPALACE)

(71) Applicant: Edward L. Maldonado, Montebello, CA (US)

(72) Inventor: Edward L. Maldonado, Montebello, CA (US)

( * ) Notice: Subject to any disclaimer, the term of this patent is extended or adjusted under 35 U.S.C. 154(b) by 451 days.

(21) Appl. No.: 14/545,831

(22) Filed: Jun. 24, 2015

(65) Prior Publication Data

US 2016/0374483 A1 Dec. 29, 2016

(51) Int. Cl.

| | |
|---|---|
| ***B65D 85/62*** | (2006.01) |
| ***A47F 7/06*** | (2006.01) |
| ***A47B 61/04*** | (2006.01) |
| *A47F 3/00* | (2006.01) |
| *A47F 11/10* | (2006.01) |
| *A47B 87/02* | (2006.01) |

(52) U.S. Cl.

CPC ..... *A47F 7/06* (2013.01); *A47B 61/04* (2013.01); *A47B 87/0276* (2013.01); *A47B 2220/0077* (2013.01); *A47F 3/001* (2013.01); *A47F 11/10* (2013.01)

(58) Field of Classification Search

CPC .. A47F 7/06; A47F 7/065; A47F 3/001; A47F 3/005; A47F 11/10; A47B 61/04; A47B 2220/0077; B65D 85/18; A45C 11/02

USPC ..... 206/8, 503–505, 509, 511; 312/114, 122

See application file for complete search history.

(56) References Cited

U.S. PATENT DOCUMENTS

| | | | |
|---|---|---|---|
| 39,299 | A | 7/1863 | Masker |
| 961,418 | A | 6/1910 | Lloyd |
| 1,252,816 | A | 1/1918 | Kuehl |
| 1,608,758 | A | 10/1926 | Alexander |
| 1,891,334 | A | 12/1932 | Overton |
| 1,956,018 | A | 4/1934 | Gilbert |
| 2,049,026 | A | 7/1936 | Savard |
| 2,534,641 | A | 2/1950 | Veigel |
| 2,536,913 | A | 1/1951 | Cox |

(Continued)

*Primary Examiner* — Luan K Bui

(57) ABSTRACT

One embodiment of the CapPalace is a furniture style Stackable/wall mountable headwear storage/display cabinet with manual/remote controlled dimmable lighting, a sliding drawer, external magnetic stacking guides for good adhesion between units, external elastic pressure electrical contacts for power between units, internally placed insulation piercing electrical contacts for power within the unit, and an outwardly opening translucent front door. A plurality of adjustable head forms are set to desired hat sizes with an Allen wrench and mounted on the drawer. In alternate embodiments without head forms the CapPalace can be made in any size or material for storage/display of collectibles, shoes, clothing, etc. The stacked configuration's base has a low voltage power supply for the lighting system in it and magnetic stacking guides and elastic pressure electrical contacts on the top surface. Use of quick connect/disconnect bolts and bolt receptors on the inner walls of units, flexible flanges on female magnetic stacking guide retainer rings, and elastic pressure and insulation piercing electrical contacts are designed so low tech users with a few hand tools can easily assemble a unit. Other embodiments are described and shown.

10 Claims, 22 Drawing Sheets

(56) References Cited

U.S. PATENT DOCUMENTS 2,561,561 A 7/1951 Cella
2,577,167 A 12/1951 Vlasis
2,612,590 A 9/1952 Lachowicz
2,659,481 A 11/1953 Jones
2,678,228 A 5/1954 Gerhardt
2,678,429 A 5/1954 Abbott
2,686,926 A 8/1954 Schacht, Jr. et al.
2,803,350 A 8/1957 Osgoodby
2,873,434 A 2/1959 Drum
2,991,496 A 7/1961 Wolf et al.
3,289,823 A 2/1966 Weiser
3,300,108 A 1/1967 Schumer
3,327,842 A 6/1967 Meredith
3,438,480 A 4/1969 Chabrelot
3,465,926 A 9/1969 Schwartz et al.
3,465,927 A 9/1969 Belokin, Jr.
3,516,111 A 6/1970 Heyman
3,532,317 A 10/1970 Adler
3,587,836 A * 6/1971 Brown ..... A45C 11/00 206/8
3,606,108 A 9/1971 Baugh
3,669,035 A 6/1972 Grossman
3,791,528 A 2/1974 Brengord
4,008,872 A 2/1977 Thompson
4,231,632 A 11/1980 Badoz
4,243,287 A 1/1981 Smith
4,288,918 A 9/1981 Nijman
4,431,419 A 2/1984 Portnoy
4,548,451 A 10/1985 Benarr et al.
4,673,153 A 6/1987 Hilty et al.
4,715,825 A 12/1987 Moussie et al.
4,757,910 A 7/1988 Box
4,805,782 A 2/1989 Hale
4,813,129 A 3/1989 Karnezos
4,824,371 A 4/1989 Deutsch
4,858,247 A 8/1989 Hooser
4,896,926 A 1/1990 Vorholt
4,993,557 A 2/1991 Davis
4,997,372 A 3/1991 Shiner
4,998,992 A 3/1991 Richlin
5,002,190 A 3/1991 Moreland
5,012,531 A 5/1991 Schoonover
5,022,515 A 6/1991 Agostine
5,038,941 A 8/1991 Bastiaansen
5,050,832 A 9/1991 Lee
5,086,931 A 2/1992 Cobb
5,092,472 A 3/1992 Jones
5,137,146 A 8/1992 Stonehouse
5,137,157 A 8/1992 Lawson
5,147,120 A 9/1992 Ray
5,147,208 A 9/1992 Bachler
5,148,954 A 9/1992 Myers
5,188,325 A 2/1993 Hilty et al.
5,193,683 A 3/1993 Key
5,235,724 A 8/1993 Perrin et al.
5,240,123 A 8/1993 Hawk
5,244,102 A 9/1993 Koenig
5,265,737 A 11/1993 Freeby
5,295,588 A 3/1994 Neirinckx
5,303,829 A 4/1994 Kennedy
5,348,166 A 9/1994 Lema
5,396,994 A 3/1995 Fitzgerald
5,411,144 A 3/1995 Deupree
5,425,763 A 6/1995 Stemmann
5,450,967 A 9/1995 Mallory
5,480,073 A 1/1996 LaManna
5,503,312 A 4/1996 Kassner
5,515,978 A 5/1996 Moran
5,538,144 A 7/1996 Reed
5,566,837 A 10/1996 Lema
5,601,197 A 2/1997 Baxter
5,683,002 A 11/1997 Bayside
D390,046 S 2/1998 Rheinish
5,718,533 A 2/1998 Mullet et al.
5,725,134 A 3/1998 Weltge
5,727,694 A 3/1998 Larson
5,758,779 A 6/1998 Atkins
5,823,328 A 10/1998 Fomby
D401,079 S 11/1998 Clarke
5,845,778 A 12/1998 Hickey, Jr.
5,855,063 A 1/1999 Schreiber
5,921,403 A 7/1999 Coffaro
5,992,665 A * 11/1999 Deeter ..... A45C 7/0045 206/504
D426,723 S 6/2000 Waugh
6,223,910 B1 5/2001 Levin et al.
6,253,973 B1 7/2001 Jones
6,311,879 B1 11/2001 Rigler
6,422,400 B1 7/2002 Miller
6,422,401 B1 7/2002 Roten
6,523,728 B2 2/2003 Lee
6,508,021 B2 6/2003 Ong
6,578,716 B1 6/2003 Wei
6,648,189 B1 11/2003 Minton
6,695,418 B2 2/2004 Skov
6,840,411 B2 1/2005 Fritz
D508,086 S 8/2005 Probnow
6,968,985 B1 11/2005 Caccavallo
7,146,760 B2 * 12/2006 Yiu ..... A47F 3/001 312/114
7,147,112 B2 12/2006 Penson
D538,064 S 3/2007 Schechtor
7,380,691 B2 6/2008 Kroll et al.
7,423,506 B2 9/2008 Terasaki
2002/0134700 A1 * 9/2002 Toguchi ..... B65D 21/0209 206/503
2003/0193275 A1 * 10/2003 Canedy ..... A47F 3/002 312/114
2008/0035507 A1 * 2/2008 Collister ..... B25H 3/006 206/349
2009/0039742 A1 * 2/2009 Ripley, Jr. ..... A47F 3/004 312/114
2009/0090647 A1 * 4/2009 Panchal ..... B65D 21/0204 206/504

* cited by examiner

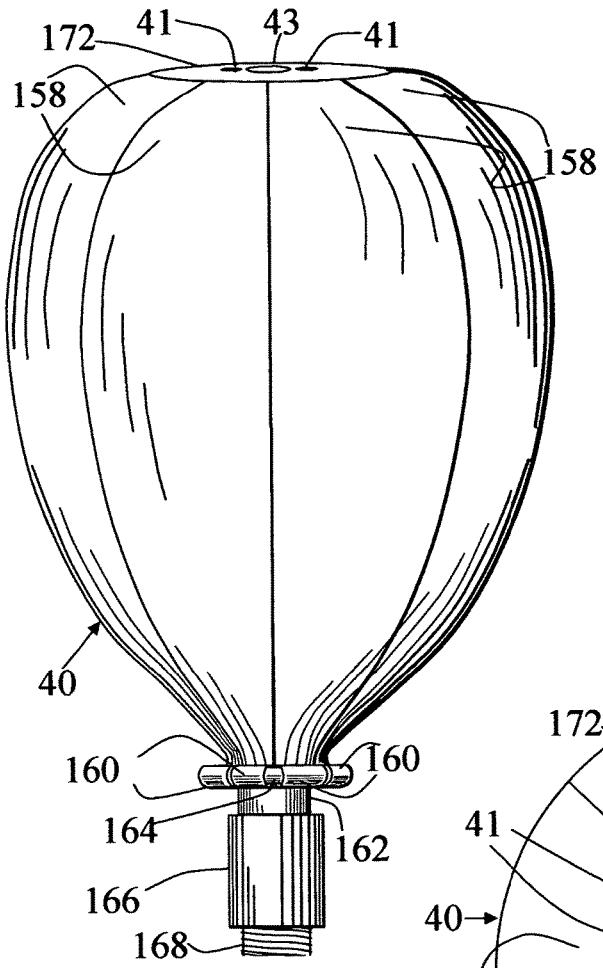
FIG.20A
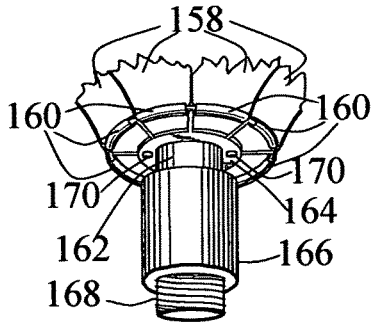
FIG.20B
FIG.20C
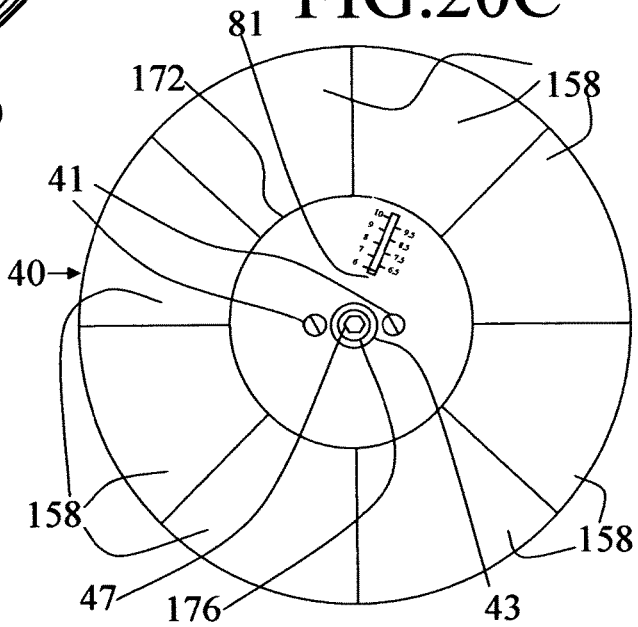

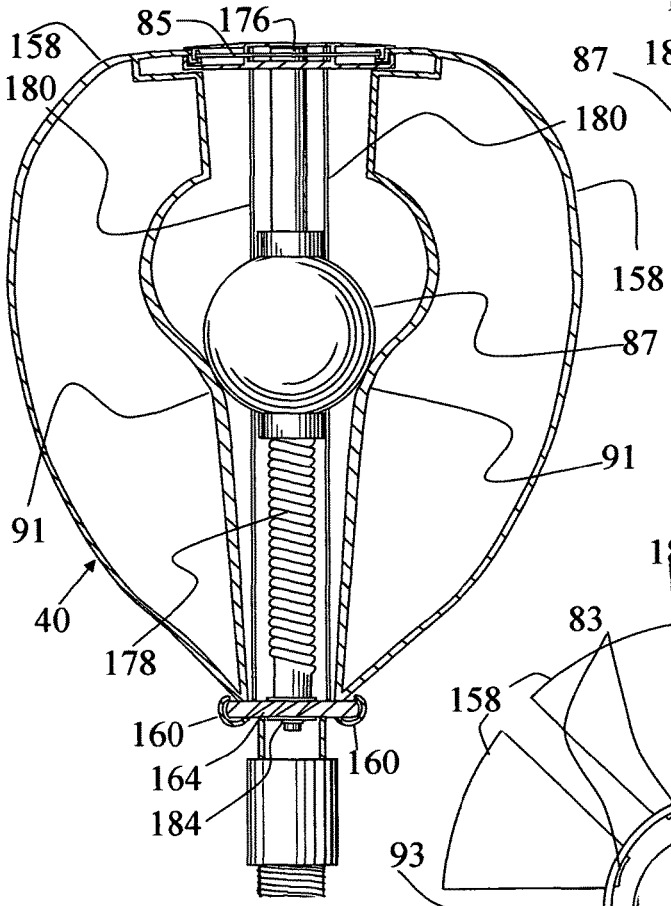
FIG.23A
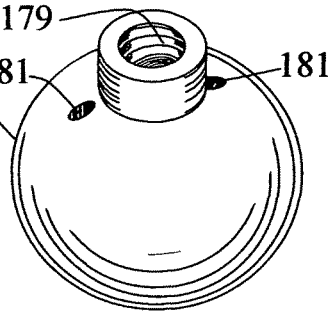
FIG.23C
FIG.23B
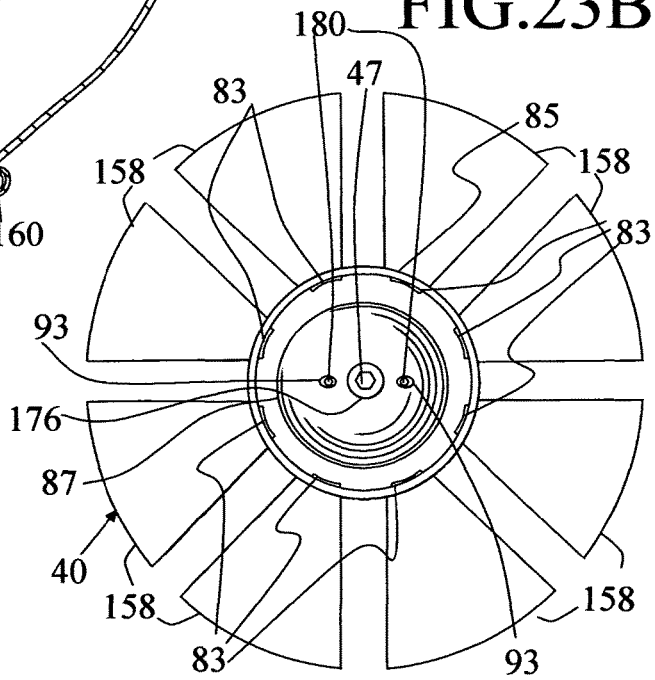

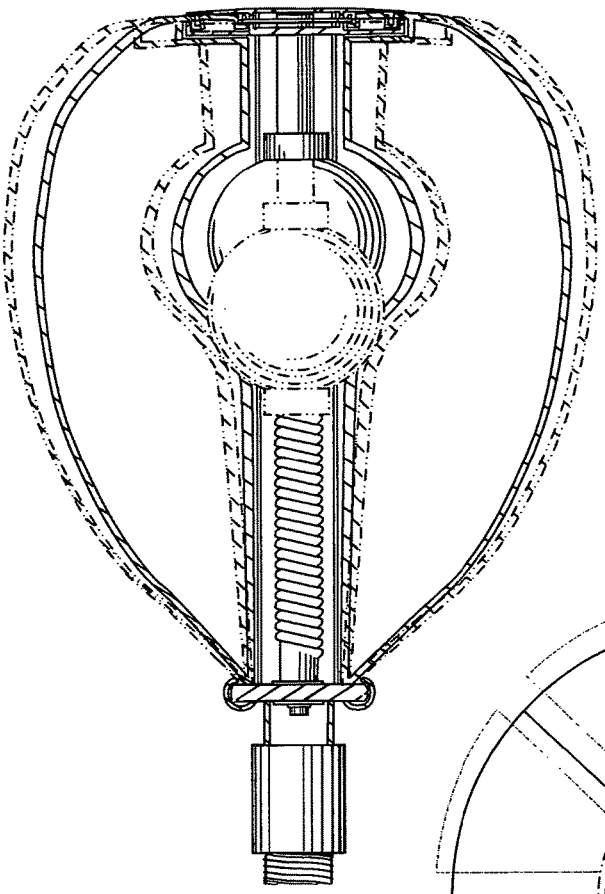
FIG.24A
FIG.24B
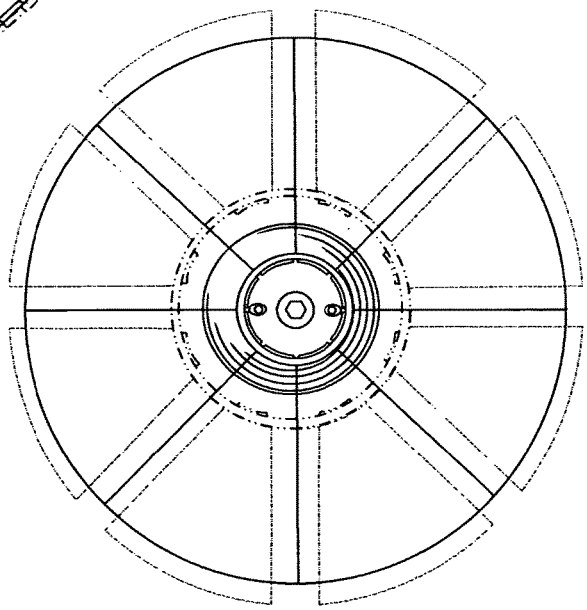

STACKABLE/WALL MOUNTABLE HEADWEAR STORAGE AND DISPLAY CABINET SYSTEM WITH VARIABLE LIGHTING (CAPPALACE)

CROSS-REFERENCE TO RELATED APPLICATIONS

Not applicable

FEDERALLY SPONSORED RESEARCH

Not applicable

SEQUENCE LISTING Oreg. PROGRAM

Not applicable

BACKGROUND OF THE INVENTION

Field of Invention

This invention primarily relates to the storage and display of baseball style caps and other headwear, specifically the storage and display of fitted fashionable baseball style caps, hats, turbines, wigs and other headwear and alternatively without a head form for the storage/display of sweaters, shoes or other valuable collectibles etc.

Prior Art

Inexpensive adjustable or elasticized baseball style caps were widely used the last 50 years of the $20^{th}$ century. Furthermore, because adjustable caps tend to bunch in the rear, wrinkles are an inherent characteristic of this design. For that reason wearers of adjustable caps have, traditionally, made very little effort to maintain a well formed crown and often neglected the bill as well.

In recent years major baseball style cap manufacturers have introduced more expensive highly fashionable fitted baseball style caps in all colors, patterns and materials. Contemporary young urban fashion, now, requires immaculate perfectly shaped fitted baseball style caps that are color coordinated with their attire. The pride and care of these caps is the same as that bestowed on the top hats and Bowler Derbies of yesteryear. When not worn these caps must be stored in a way that keeps them clean and ensures that the integrity of the caps' perfectly shaped crown and bill is not compromised. Furthermore, since these caps are color coordinated with the person's attire he/she, typically, owns numerous caps. Thus creating a strong need for an easy to assemble stackable/wall mountable furniture style storage system that accommodates a plurality of caps, adjustable head forms to promote each cap's immaculate appearance, and affords proper lighting for easy view through a transparent cantilevered door and easy sliding drawer providing quick cap selection when dressing, and does not infringe on closet space as bulky hat boxes and closet pole hanging racks do.

Some headwear storage devices now available to the public such as hat boxes protect the caps from dust and to certain extent promote the protection of the caps shape. But they are bulky and take up a lot of closet space and since the contents are, generally, not visible, quick cap selection when dressing becomes a time consuming chore. Other storage devices use head forms which is a step in the right direction, but the head forms are, usually, not adjustable to the cap size or do not adequately mimic a human head resulting in the inadvertent distortion of the caps crown. The use of inflatable balloon type head forms can be blown to specific hat sizes, but, the shape and size of these devices are not reliable over a long period of time as air leakage and material deterioration can result in the distortion of the device. There are also headwear storage devices available that can accommodate a multitude of caps in the form of a tree, wall mounted rack, or closet hung rack. However, these storage devices, invariably, require that the crown be folded forward or crimp the bill and or the crown as a way of retaining the cap on the rack. Many of these storage devices do not isolate the contents from the environment so the caps are subject to being distorted and or are exposed to accumulation of dust. Some enclosed devices that are designed to accept a plurality of caps do provide protection from dust, but, typically, require that the caps' crowns be folded forward in order to cram the caps into the device, thus distorting the crowns.

In an alternative embodiment without the head forms my invention is also uniquely suitable for the storage and display of sweaters, shoes, valuable collectibles, etc.

The patent search has resulted in over 100 prior art patents which in one way or another touch on one or more aspects of this embodiment. Therefore, the 9 following comparison tables were established to more efficiently demonstrate the novelty and unexpected improvements introduced by this embodiment:

Table 1-1 Prior Art Group A Headwear Storage Units
Table 1-2 Prior Art Group B Head Forms
Table 1-3 Prior Art Group C Modular Units
Table 1-4 Prior Art Group D Wall Mounts
Table 1-5 Prior Art Group E Stackable Guides
Table 1-6 Prior Art Group F Magnetic Coupling
Table 1-7 Prior Art Group G Pressure Electrical Contacts
Table 1-8 Prior Art Group H Insulation Piercing Electrical Contacts
Table 1-9 Prior Art Group I Door Assemblies Art Group A Headwear Storage Units—This group consists of every conceivable method of storing headwear for various purposes from store displays to closet hanging racks. The following discussion will not make an effort to describe each prior art in detail as the sheer quantity makes that a cumbersome task. I do, however, declare that these prior art patents are indeed all different forms of headwear storage devices that share some features with my embodiment. The subgroups below are arranged in descending order starting with prior art sharing the largest quantity of features with my embodiment and working down to those sharing the least amount of features. Each subgroup briefly indentifies the patents and the related common features. The paragraph following this group is a statistical summarization of the preceding information and includes a briefing of the features that my embodiment has but are not shared by any of the prior art in this category. Table 1-1 following this group is a visual chart supporting this information.

U.S. Pat. No. 1,608,758 to Sylvan Elroy Alexander (1926); U.S. Pat. No. 4,673,153 and U.S. Pat. No. 5,188,325 to Calvin A. Hilty et al. (1987 and 1993 respectively); U.S. Pat. No. 5,038,941 to Jac Bastiaansen (1991); U.S. Pat. No. 5,137,157 to James D. Lawson (1992); U.S. Pat. No. 5,240,123 to Gary D. Hawk (1993); U.S. Pat. No. 5,244,102 to Robert H. Koenig (1993); U.S. Pat. No. 5,295,588 to Thomas R. Neirinckx (1994); U.S. Pat. No. 5,396,994 to Robert C. Fitzgerald (1995); U.S. Pat. No. 5,480,073 to Frank A. LaManna (1996); U.S. Pat. No. 5,758,779 to Charlie C. Atkins (1998); U.S. Pat. No. 5,921,403 to Ronald Coffaro (1999); U.S. Pat. No. 6,422,400 B1 to Brett K.

Miller (2001); U.S. Pat. No. 6,422,401 B1 to Randel E. Roten (2002); and U.S. Pat. No. 6,840,411 B2 to Wayne Fritz (2005) all share the following 5 features with my embodiment: easily assembled, contents are visible, easy accessibility of contents, the capacity to store a plurality of caps and wall mountable. In addition to the five common features listed above in this subgroup U.S. Pat. Nos. 1,608,758; 5,038,941; 5,758,779; and 5,921,403 also share the additional feature of having the capability to maximize closet space and U.S. Pat. Nos. 1,608,758 and 5,038,941 share the additional feature of fitting into any décor.

U.S. Pat. Nos. D538,064 S to Richard J. Schector (2007); U.S. Pat. No. 4,993,557 to Bert Davis (1991); U.S. Pat. No. 5,002,190 to Lonnie Moreland (1991); U.S. Pat. No. 5,265,737 to John J. Freeby (1993); U.S. Pat. No. 5,303,829 to Susan B. Kennedy (1994); U.S. Pat. No. 5,411,144 to David W. Deupree (1995); U.S. Pat. No. 5,450,967 to Ralph Mallory (1995); U.S. Pat. No. 5,515,978 to James E. Moran (1996); U.S. Pat. No. 5,601,197 to Dean Baxter (1997); U.S. Pat. No. 5,683,002 to Robert Rayside (1997); U.S. Pat. No. 5,727,1584 to James Duane Larson (1998); U.S. Pat. No. 5,845,778 to John Hickey, Jr. (1998); U.S. Pat. No. 5,566,837 to Greg Lema (1996); U.S. Pat. No. 6,223,910 B1 to Greg M. Levin, et al. (2001); U.S. Pat. No. 6,311,879B1 to Jerry H. Rigler: Brenda J. Rigler (2001); and U.S. Pat. No. 7,147,112 B2 to Alphonia Penson (2006) share the following 4 features with my embodiment: easily assembled, contents are visible, easy accessibility of contents, and the capacity to store a plurality of caps. In addition to the five common features listed above in this subgroup U.S. Pat. Nos. 4,993,557 and 5,845,778 also share the feature of having the capability to fit into any décor and U.S. Pat. Nos. 5,303,829; 5,683,002; 5,566,837 also share the additional feature of the capability to maximize closet space.

U.S. Pat. No. 5,086,931 to Denis Cobb (1992); U.S. Pat. No. 5,137,146 to Patricia G. Stonehouse (1992); U.S. Pat. No. 5,348,166 to Greg Lema (1994); and U.S. Pat. No. 426,723D to Eric Waugh (2000) share the following 3 features with my embodiment: easily assembled, contents are visible, the capacity to store a plurality of caps. In addition to the three common features listed above in this subgroup U.S. Pat. Nos. 5,137,146 and 426,723D also share the feature of providing dust protection for the contents, U.S. Pat. No. 5,137,146 shares the feature of promoting the caps' crown and bill shape Integrity and U.S. Pat. Nos. 5,086,931 and 426,723D also share the additional feature of being wall mountable.

U.S. Pat. No. 2,659,481 to William S. Jones (1953) and U.S. Pat. No. 5,012,531 to Richard L. Schoonoever (1991) share the following three features with my embodiment: contents are easily visible, easy to assemble, and protects contents from dust. In addition to the three common features listed above in this subgroup U.S. Pat. No. 2,659,481 shares the additional feature of having the capability to promote the caps' crown and bill integrity.

U.S. Pat. No. 2,049,026 to Henry Savard (1936); U.S. Pat. No. 5,092,472 to Kevin C. Jones (1992); and U.S. Pat. No. 5,538,144 to Scott W. Reed (1996 (1998) all share the following three features with my embodiment: easily assembled, contents are easily visible and contents easily accessible. In addition to the three common features listed above in this subgroup, U.S. Pat. No. 5,538,144 shares the following two additional features with my embodiment: wall mountable and uniformly adjustable head forms to hat sizes.

U.S. Pat. No. 5,022,515 to Anthony Agostine (1991) and U.S. Pat. No. 5,823,328 to Kenneth A. Fomby (1998) share the following feature with my embodiment: Ease of assembly. In addition to the common feature listed above in this subgroup, U.S. Pat. No. 5,022,515 shares the additional features: stores a plurality of caps; wall mountable; and protects the contents from dust and U.S. Pat. No. 5,823,328 shares the additional features of protection from dust and promotion of the caps' crown and bill shape integrity.

To summarize, there are 42 prior art patents categorized as headwear storage. The entire prior art patents in this category are fairly easy to assemble. Of the 42 prior art patents in this category forty afford easy view of contents, thirty six have the capability to hold a plurality of headwear, thirty four afford easy accessibility of contents, nineteen are wall mountable, eight provide dust protection for the contents, seven result in additional closet space when used, four promote the headwear's crown, brim or bill shape integrity, four are designed to fit into some décor, one is designed to be used as furniture, one contains variably adjustable head forms. None of the 42 prior art patents in this category have any of the following features: stackable, a sliding drawer to afford easier access of contents, dimmable cabinet lighting to aid in the selection of contents, a cantilevered transparent door to provide easy access and view of contents, stacking magnetic guides that simplify the stacking of the cabinets and allows the cabinets to adhere to one another vertically and horizontally with minimal use of hardware or tools, pressure and insulation piercing electrical contact technology that simplifies the cabinet construction so that a user with minimal electrical technical knowledge can assemble and install the units, expandable wall mounting tracks that allow the modules to slide on for easy installation, quick disconnect technology that simplifies assembly, and designed to be used as furniture.

Table 1-1 compares the features of the prior art discussed above with the features of my embodiment. As the table clearly shows all of the listed prior art patents in the chart have at least 3 features in common with my embodiment. However, none of the prior art in the table share all the features with my embodiment. The features incorporated in my embodiment are necessary to provide an attractive easily assembled furniture type headwear cabinet which protects the contents from dust and fits into any modern décor with built-in dimmable lighting, a transparent cantilevered door that opens and closes on door tracks, and a sliding drawer for quick and easy accessibility of contents in any ambient lighting conditions; adjustable head forms that variably adjust to the exact hat sizes to promote the shape integrity of the headwear's crowns, brims, or bills which is so important in today's youth oriented fashion; magnetic guides allowing the user to easily bind stacked or horizontally wall mounted units; pressure and insulation piercing electrical contact technology making it possible for the least technical user to easily assemble the units; and quick connect/disconnect technology to aid the user in quick and simple construction of the units with minimal use of tools. This embodiment makes it possible for today's fashion conscious individuals to easily store and retrieve their expensive headwear in a way befitting its value without encroaching on often precious limited closet space in a revolutionary new furniture style headwear cabinet that can be quickly assembled, stacked or wall mounted.

TABLE 1-1

CATEGORY A, HEADWEAR STORAGE

| Comparison Table of my embodiment's headwear storage features to prior art's features | My Embodiment | PRIOR ART 1608758 | 2049026 | 2659481 | 4673153 | 4993557 | 5002190 | 5012531 | 5022515 | 5038941 | 50815831 | 5092472 | 5137146 |
|---|---|---|---|---|---|---|---|---|---|---|---|---|---|
| Contents Easily Accessible | ● | ● | ● | | ● | ● | ● | | | ● | | ● | |
| Stores More Than One Cap | ● | ● | | | ● | ● | ● | | ● | ● | ● | | ● |
| Contents are visible | ● | ● | ● | ● | ● | ● | ● | ● | | ● | ● | ● | ● |
| Easy Assembly | ● | ● | ● | ● | ● | ● | ● | ● | ● | ● | ● | ● | ● |
| Wall Mountable | ● | ● | | | ● | | | | ● | ● | ● | | |
| Promotes Crown & Bill Shape Integrity | ● | | | ● | | | | | | | | | ● |
| Protects Contents from Dust | ● | | ● | ● | | | | ● | ● | | | | ● |
| Uniformly Adjustable Head Forms to Hat Sizes | ● | | | | | | | | | | | | |
| Fits into any décor | ● | ● | | | | ● | | | | | | | |
| Furniture Style Cabinet | ● | ● | | | | | | | | | | | |
| Stackable | ● | | | | | | | | | | | | |
| Sliding Drawer | ● | | | | | | | | | | | | |
| Does not take up closet space | ● | ● | | | | | | | | ● | | | |
| Cabinet Lighting with Dimmer | ● | | | | | | | | | | | | |
| Transparent Door | ● | | | | | | | | | | | | |
| Magnetic Stacking Guides | ● | | | | | | | | | | | | |
| Pressure Contacts | ● | | | | | | | | | | | | |
| Insulation piercing Contacts | ● | | | | | | | | | | | | |
| Expandable Wall Mounting Track | ● | | | | | | | | | | | | |
| Mods slide together on Mounting track | ● | | | | | | | | | | | | |
| Door Tracks | ● | | | | | | | | | | | | |
| Quick Disconnect Technology | ● | | | | | | | | | | | | |

| Comparison Table of my embodiment's headwear storage features to prior art's features | My Embodiment | PRIOR ART 5137157 | 5188325 | 5240123 | 5244102 | 5265737 | 5295588 | 5303829 | 5348166 | 53915894 | 5411144 | 5450967 | 5480073 |
|---|---|---|---|---|---|---|---|---|---|---|---|---|---|
| Contents Easily Accessible | ● | ● | ● | ● | ● | ● | ● | ● | | ● | ● | ● | ● |
| Stores More Than One Cap | ● | ● | ● | ● | ● | ● | ● | ● | ● | ● | ● | ● | ● |
| Contents are visible | ● | ● | ● | ● | ● | ● | ● | ● | ● | ● | ● | ● | ● |
| Easy Assembly | ● | ● | ● | ● | ● | ● | ● | ● | ● | ● | ● | ● | ● |
| Wall Mountable | ● | ● | ● | ● | ● | | ● | | | ● | | | ● |
| Promotes Crown & Bill Shape Integrity | ● | | | | | | | | | | | | |
| Protects Contents from Dust | ● | | | | | | | | | | | | |
| Uniformly Adjustable Head Forms to Hat Sizes | ● | | | | | | | | | | | | |
| Fits into any décor | ● | | | | | | | | | | | | |
| Furniture Style Cabinet | ● | | | | | | | | | | | | |
| Stackable | ● | | | | | | | | | | | | |

TABLE 1-1-continued

| CATEGORY A, HEADWEAR STORAGE | |
|---|---|
| Sliding Drawer | ● |
| Does not take up closet space | ● |
| Cabinet Lighting with Dimmer | ● |
| Transparent Door | ● |
| Magnetic Stacking Guides | ● |
| Pressure Contacts | ● |
| Insulation piercing Contacts | ● |
| Expandable Wall Mounting Track | ● |
| Mods slide together on Mounting track | ● |
| Door Tracks | ● |
| Quick Disconnect Technology | ● |

| Comparison Table of my embodiment's headwear storage features to prior art's | | PRIOR ART | | | | | | | | | | | |
|---|---|---|---|---|---|---|---|---|---|---|---|---|---|
| features | My Embodiment | 5515978 | 5538144 | 5601197 | 5683002 | 57271584 | 5758779 | 5823328 | 5845778 | 5921403 | 426723D | 5566837 | 6223910B1 |
| Contents Easily Accessible | ● | ● | ● | ● | ● | ● | ● | | ● | ● | | ● | ● |
| Stores More Than One Cap | ● | ● | | ● | ● | ● | ● | | ● | ● | ● | ● | ● |
| Contents are visible | ● | ● | ● | ● | ● | ● | ● | | ● | ● | ● | ● | ● |
| Easy Assembly | ● | ● | ● | ● | ● | ● | ● | ● | ● | ● | ● | ● | ● |
| Wall Mountable | ● | | ● | | | | ● | | | ● | ● | | |
| Promotes Crown & Bill Shape Integrity | ● | | | | | | | ● | | | | | |
| Protects Contents from Dust | ● | | | | | | | ● | ● | | ● | | |
| Uniformly Adjustable Head Forms to Hat Sizes | ● | | ● | | | | | | | | | | |
| Fits into any décor | ● | | | | | | ● | | ● | | | | |
| Furniture Style Cabinet | ● | | | | | | | | | | | | |
| Stackable | ● | | | | | | | | | | | | |
| Sliding Drawer | ● | | | | | | | | | | | | |
| Does not take up closet space | ● | | | | ● | | ● | | | ● | | ● | |
| Cabinet Lighting with Dimmer | ● | | | | | | | | | | | | |
| Transparent Door | ● | | | | | | | | | | | | |
| Magnetic Stacking Guides | ● | | | | | | | | | | | | |
| Pressure Contacts | ● | | | | | | | | | | | | |
| Insulation piercing Contacts | ● | | | | | | | | | | | | |
| Expandable Wall Mounting Track | ● | | | | | | | | | | | | |
| Mods slide together on Mounting track | ● | | | | | | | | | | | | |
| Door Tracks | ● | | | | | | | | | | | | |
| Quick Disconnect Technology | ● | | | | | | | | | | | | |

TABLE 1-1-continued

| CATEGORY A, HEADWEAR STORAGE | | | | | | | |
|---|---|---|---|---|---|---|---|
| Comparison Table of my embodiment's headwear storage features to prior art's | | PRIOR ART | | | | | |
| features | My Embodiment | 6311879B1 | 6422400B1 | 6422401B1 | 6840411B2 | 7147112B2 | D538064S |
| Contents Easily Accessible | ● | ● | ● | ● | ● | ● | ● |
| Stores More Than One Cap | ● | ● | ● | ● | ● | ● | ● |
| Contents are visible | ● | ● | ● | ● | ● | ● | ● |
| Easy Assembly | ● | ● | ● | ● | ● | ● | ● |
| Wall Mountable | ● | | ● | ● | ● | | |
| Promotes Crown & Bill Shape Integrity | ● | | | | | | ● |
| Protects Contents from Dust | ● | | | | | | |
| Uniformly Adjustable Head Forms to Hat Sizes | ● | | | | | | |
| Fits into any décor | ● | | | | | | |
| Furniture Style Cabinet | ● | | | | | | |
| Stackable | ● | | | | | | |
| Sliding Drawer | ● | | | | | | |
| Does not take up closet space | ● | | | | | | |
| Cabinet Lighting with Dimmer | ● | | | | | | |
| Transparent Door | ● | | | | | | |
| Magnetic Stacking Guides | ● | | | | | | |
| Pressure Contacts | ● | | | | | | |
| Insulation piercing Contacts | ● | | | | | | |
| Expandable Wall Mounting Track | ● | | | | | | |
| Mods slide together on Mounting track | ● | | | | | | |
| Door Tracks | ● | | | | | | |
| Quick Disconnect Technology | ● | | | | | | |

Art Group B Head Forms—Prior art in this category includes various devices from hat trees to wig stands that are used for headwear shipping, hat boxes, hat drying, wig styling, transporting, displaying and reshaping. Some of these devices are stand alone items and others are incorporated into shipping containers. In most cases these devices do promote the integrity of the caps' crown and or bill. A handful of these prior art patents have some type of head form adjustment such as screw worm mechanisms, inflatable balloons, and oversized flexible head forms that require the user to force the caps' crowns on.

As in the preceding category the subgroups below are arranged in descending order starting with prior art sharing the largest quantity of features with my embodiment and working down to those sharing the least amount of features. Each subgroup briefly indentifies the patents and the related common features. The paragraph following this category is a statistical summarization of the preceding information and includes a briefing of the features that my embodiment has but are not shared by any of the prior art in this category. Table 1-2 following this category is a visual chart supporting this information.

U.S. Pat. No. 39,299 to Jason H. Masker (1863); U.S. Pat. No. 2,536,913 to Sumner C. Cox (1951); U.S. Pat. No. 2,803,350 to Reginald D. Osgoodby (1957); U.S. Pat. No. 3,300,108 to Louis Schumer (1967); U.S. Pat. No. 3,465,927 to Paul Belokin, Jr. (19158); U.S. Pat. No. 3,465,926 to Natalie Pels Schwartz et al. (19158); U.S. Pat. No. 3,606,108 to Ronald K. Baugh and Susan L. Baugh (1971); U.S. Pat. No. 4,858,247 to Donald L. Hooser (1989); U.S. Pat. No. 4,998,992 to Milton Richlin and Aloysis Dubeck (1991); U.S. Pat. No. 5,148,954 to Clifford J. Myers (1992); U.S. Pat. No. 5,503,312 to Gary Kassner (1996); U.S. Pat. No. 5,725,134 to Brian Richard Weltge (1998); U.S. Pat. No. 6,578,716 B1 to Chang-Min Wei (2003); and U.S. Pat. No. 6,523,728 B2 to Razgo Lee (2003) all share the following 4 features with my embodiment: contents are easily accessible, easily assembled, contents are visible, and promotes caps crown and bill integrity. In addition to the four common features listed above in this subgroup U.S. Pat. Nos. 2,536,913; 3,465,926; 3,465,927; 4,858,247 and; 5,148,954 also share the additional feature of being adjustable and U.S. Pat. No. 6,578,716 B1 shares the additional feature of being wall mountable. In addition to the 4 common features listed above in this subgroup U.S. Pat. No. 7,380,1581 B2 shares the additional feature of promoting caps crown and bill shape integrity.

U.S. Pat. No. 2,577,167 to George Vlasis (1951); U.S. Pat. No. 6,253,973 B1 to Roger Jones (2001); U.S. Pat. No. 6,648,189 B1 to Thomas Minton (2003); and U.S. Pat. No. 6,968,985B1 to Salvatore S. Caccavallo (2005) all share the following 4 features with my embodiment: contents are easily accessible, contents are visible, promotes caps crown and bill shape integrity, and is adjustable.

U.S. Pat. No. 1,891,334 to George Overton (1932); U.S. Pat. No. 3,289,823 to Simon Weiser and Maurice D. Gottlieb (1966); U.S. Pat. No. 3,327,842 to Gary E. Meredith and Phillip C. Lende (1967); and U.S. Pat. No. 3,438,480 to Paul L. Chabrelot (19158) all share the following 4 features with my embodiment: contents are easily accessible, easy assembly, promotes caps crown and bill shape integrity, and is adjustable.

U.S. Pat. Nos. D508,086 S to Arla A. Probnow (2005); U.S. Pat. No. 961,418 to Herbert D. Lloyd (1910); U.S. Pat. No. 4,805,782 to Everett D. Hale (1989); U.S. Pat. No. 401,079 D to Lillian E. Clarke (1998); 390,046 D to Robert Rheinish and Shirley Rhenish (1998); and U.S. Pat. No. 7,380,1581 B2 to Gregory Arthur Kroll, et al. (2008) all share the following 3 features with my embodiment: contents are easily accessible, easily assembled, and contents are visible.

To summarize, there are 28 prior art patents in the head form category. The entire prior art patents in this category give easy accessibility of contents. Of the 28 prior art patents in this category twenty four afford easy view of contents, twenty four are easy to assemble, one is wall mountable, twenty three promote the caps' crown and bill shape integrity, four protect the contents from dust, and eleven are adjustable. None of the 28 prior art patents in this category have any of the following features: the ability to store or hold a plurality of caps, the potential to increase available closet space for the user, an attractive stackable/wall mountable easily assembled dust proof furniture style cabinet with a cantilevered transparent door and sliding drawer to provide easy access and view of contents, and dimmable cabinet lighting to aid in the selection of contents.

Table 1-2 compares the features of the prior art discussed above with the features of my embodiment. As the table clearly shows all of the listed prior art patents in the chart has at least 3 features in common with my embodiment. However, none of the prior art in the table share all the features with my embodiment. The features incorporated in my embodiment are necessary to provide an attractive easily assembled furniture type headwear cabinet that can be built in any size and or shape based on consumers' specifications, protects the contents from dust and fits into any modern décor with built-in dimmable lighting, a transparent cantilevered door that opens and closes on door tracks, and a sliding drawer for quick and easy accessibility of contents in any ambient lighting conditions; adjustable head forms that variably adjust to the exact hat sizes to promote the shape integrity of the headwear's crowns, brims, or bills which is so important in today's youth oriented fashion; magnetic guides allowing the user to easily bind stacked or horizontally wall mounted units with minimal use of tools. This embodiment makes it possible for today's fashion conscious individuals to easily store and retrieve their expensive headwear in a way befitting its value without encroaching on often precious limited closet space in a revolutionary new furniture style headwear cabinet that can be quickly assembled, stacked or wall mounted.

TABLE 1-2

CATEGORY B, HEAD FORMS

| Comparison Table of my embodiment's head form features to prior art's | | PRYOR ART | | | | | | | | | | | |
|---|---|---|---|---|---|---|---|---|---|---|---|---|---|
| features | My Embodiment | 39299 | D508086S | 961418 | 1891334 | 25315813 | 2577167 | 2803350 | 3289823 | 3300108 | 3327842 | 3438480 | 3465927 |
| Contents Easily Accessible | ● | ● | ● | ● | ● | ● | ● | ● | ● | ● | ● | ● | ● |
| Stores More Than One Cap | ● | | | | | | | | | | | | |
| Contents are visible | ● | ● | ● | ● | | ● | ● | ● | | ● | | | ● |
| Easy Assembly | ● | ● | ● | ● | ● | ● | | ● | ● | ● | ● | ● | ● |
| Wall Mountable | ● | | | | | | | | | | | | |
| Promotes Crown & Bill Shape Integrity | ● | ● | | | ● | ● | ● | ● | ● | ● | ● | ● | ● |
| Protects Contents from Dust | ● | | | | ● | | | | ● | | ● | ● | |
| Uniformly Adjustable Head Forms to Hat Sizes | ● | | | ● | | ● | ● | | | | | | ● |
| Fits into any décor | ● | | | | | | | | | | | | |
| Furniture Style Cabinet | ● | | | | | | | | | | | | |
| Stackable | ● | | | | | | | | | | | | |
| Sliding Drawer | ● | | | | | | | | | | | | |
| Does not take up closet space | ● | | | | | | | | | | | | |
| Cabinet Lighting with Dimmer | ● | | | | | | | | | | | | |
| Transparent Door | ● | | | | | | | | | | | | |
| Magnetic Stacking Guides | ● | | | | | | | | | | | | |
| Pressure Contacts | ● | | | | | | | | | | | | |
| Insulation piercing Contacts | ● | | | | | | | | | | | | |
| Expandable Wall Mounting Track | ● | | | | | | | | | | | | |
| Mods slide together on Mounting track | ● | | | | | | | | | | | | |
| Door Tracks | ● | | | | | | | | | | | | |
| Quick Disconnect Technology | ● | | | | | | | | | | | | |

| Comparison Table of my embodiment's head form features to prior art's | | PRYOR ART | | | | | | | | | | | |
|---|---|---|---|---|---|---|---|---|---|---|---|---|---|
| features | My Embodiment | 3465926 | 3606108 | 390046D | 401079D | 4805782 | 4858247 | 4998992 | 5148954 | 5503312 | 5725134 | 6253973B1 | 6523728B2 |
| Contents Easily Accessible | ● | ● | ● | ● | ● | ● | ● | ● | ● | ● | ● | ● | ● |
| Stores More Than One Cap | ● | | | | | | | | | | | | |
| Contents are visible | ● | ● | ● | ● | ● | ● | ● | ● | ● | ● | ● | ● | ● |
| Easy Assembly | ● | ● | ● | ● | ● | ● | ● | ● | ● | ● | ● | | ● |
| Wall Mountable | ● | | | | | | | | | | | | |
| Promotes Crown & Bill Shape Integrity | ● | ● | ● | | | | ● | ● | ● | ● | ● | ● | ● |
| Protects Contents from Dust | ● | | | | | | | | | | | | |
| Uniformly Adjustable Head | ● | ● | | | | | ● | | ● | | | ● | |

TABLE 1-2-continued

| CATEGORY B, HEAD FORMS | |
|---|---|
| Forms to Hat Sizes | |
| Fits into any décor | ● |
| Furniture Style Cabinet | ● |
| Stackable | ● |
| Sliding Drawer | ● |
| Does not take up closet space | ● |
| Cabinet Lighting with Dimmer | ● |
| Transparent Door | ● |
| Magnetic Stacking Guides | ● |
| Pressure Contacts | ● |
| Insulation piercing Contacts | ● |
| Expandable Wall Mounting Track | ● |
| Mods slide together on Mounting track | ● |
| Door Tracks | ● |
| Quick Disconnect Technology | ● |

| Comparison Table of my embodiment's head form features to prior art's features | My Embodiment | PRYOR ART | | | |
|---|---|---|---|---|---|
| | | 6578716B1 | 6648189B1 | 15868985B1 | 73801581B2 |
| Contents Easily Accessible | ● | ● | ● | ● | ● |
| Stores More Than One Cap | ● | | | | |
| Contents are visible | ● | ● | ● | ● | ● |
| Easy Assembly | ● | ● | | | ● |
| Wall Mountable | ● | ● | | | |
| Promotes Crown & Bill Shape Integrity | ● | ● | ● | ● | ● |
| Protects Contents from Dust | ● | | | | |
| Uniformly Adjustable Head Forms to Hat Sizes | ● | | ● | ● | ● |
| Fits into any décor | ● | | | | |
| Furniture Style Cabinet | ● | | | | |
| Stackable | ● | | | | |
| Sliding Drawer | ● | | | | |
| Does not take up closet space | ● | | | | |
| Cabinet Lighting with Dimmer | ● | | | | |
| Transparent Door | ● | | | | |
| Magnetic Stacking Guides | ● | | | | |
| Pressure Contacts | ● | | | | |
| Insulation piercing Contacts | ● | | | | |
| Expandable Wall Mounting Track | ● | | | | |

TABLE 1-2-continued

| CATEGORY B, HEAD FORMS | |
|---|---|
| Mods slide together on Mounting track | ● |
| Door Tracks | ● |
| Quick Disconnect Technology | ● |

Prior Art Group C Modular Units—This group of prior art consists of modular systems that can be expanded by stacking additional units. The compelling characteristics of my embodiment are that it is an easily assembled attractive stackable furniture style cabinet with dimmable lighting, a transparent cantilevered door, sliding drawer, and adjustable head forms. These combined characteristics result in a quick and easy to assemble expandable headwear storage system that takes the headwear storage out of the closets and makes headwear storage and retrieval more convenient while providing maximum protection for the headwear. U.S. Pat. No. 1,252,816 to Ludwig T. Huehl (1918) is an expandable filing cabinet system with an interlocking framework that allows the addition of filing cabinets in a vertical and horizontal direction. This system is not designed for the storage of headwear nor to fit in any décor this system can be expanded by stacking additional units on it, it protects the contents from dust and it has a sliding drawer. However, it is difficult to assemble, does not have dimmable lighting, adjustable head forms, and a transparent cantilevered door, and is not made easy to assemble through the use of magnetic stacking guides, pressure/insulation piercing electrical contact technology, and quick disconnect technology. U.S. Pat. No. 2,612,590 to Stanley F. Lachowicz (1952) is sectional range that allows the addition or removal of modular units and some of the units do have sliding drawers. However, it is difficult to assemble. Furthermore, it does not share any of the features with my embodiment necessary to provide a headwear storage system that is easy to assemble, fits into any modern décor, and provides maximum protection and accessibility of contents. U.S. Pat. No. 3,791,528 to Thomas Brendgord (1974) is a transportable enclosed modular system with bins that interlock into an upright column. The bins have clear plastic covers so that the contents are protected from the environment and easily visible and the bins can be easily removed and reinstalled. It, however, does not have any of the features required for a headwear storage system that is easy to assemble, fits into any modern décor, has dimmable lighting, transparent door, and sliding drawer. U.S. Pat. No. 4,896,926 to Johannes M. Verholt (1990) is a general purpose stackable system that can be used as a filing cabinet or storage cabinet. The individual units interconnect by use of quick disconnect technology, has sliding drawers and do protect the contents from dust. This prior art, however, requires that the units be preassembled so that they have to be shipped in bulky containers. Furthermore, it does not have dimmable lighting, adjustable head forms, a transparent cantilevered door, and is not wall mountable, or use magnetic stacking guides. U.S. Pat. No. 5,147,120 to Frank J. Ray (1992) is, basically, stackable modular furniture that can be configured into any type of desired furniture with drawers. It uses recesses on top of each unit and corresponding protrusions at the underside to align and secure the units to one another, it fits into any décor, has sliding drawers that protect the contents from dust and using it would certainly free up closet space. This prior art, however, requires that the units be preassembled so that they have to be shipped in bulky containers. Furthermore, it does not have dimmable lighting, adjustable head forms, a transparent cantilevered door, and is not wall mountable, or use magnetic stacking guides. U.S. Pat. No. 5,193,683 to Luther L. Key (1993) is designed as stackable containers for food service and as a toy. The stackable units are aligned by use of tabs on external walls and held together by elastic bands around the interconnected tabs. The units provide dust protection of contents. This prior art, however, requires that the units be preassembled so that they have to be shipped in bulky containers. Furthermore, it does not have dimmable lighting, adjustable head forms, a transparent cantilevered door, sliding drawer, is not wall mountable, use magnetic stacking guides, nor fit into any décor. U.S. Pat. No. 6,508,021 B2 to Bon S. Ong (2003) a stackable desk top storage device with rotatable stand at the bottom of each unit that fits snuggly into a recess at the tops of the units. This prior art is not designed to hold larger objects and except for the fact that it is a stackable modular unit, it is not capable of performing the functions of my embodiment. U.S. Pat. No. 6,1585,418 B2 to Erik L. Skov (2004) is a modular shelving system which can be purchased in a compact flat box as it comes in the form of rods and panels that are attached to the rods to form the shelving. It fits into any décor and protects the contents from dust. This prior art, however, does not have dimmable lighting, adjustable head forms, a transparent cantilevered door, sliding drawer and is not wall mountable, nor use magnetic stacking guides.

Table 1-3 compares the modular features of the prior art discussed above with the features of my embodiment. As is clearly depicted in the table, all eight prior art patents can be stacked. Four of the prior art can be easily assembled, four of the prior art provide easy accessibility of the contents, three provide dust protection for the contents, two could store a plurality of caps, two are designed with sliding drawers, one is designed as furniture, and only one would result in additional closet space if utilized. However, none of the prior art in the table share all of the features with my embodiment. Furthermore, none of the prior art in this category shared any of the other features with my embodiment which are necessary to provide storage with built-in dimmable lighting, a transparent cantilevered door that opens and closes on door tracks for quick accessibility of contents in any ambient lighting conditions, adjustable head forms that variably adjust to the exact hat sizes to promote the shape integrity of the headwear's crowns, brims, or bills that are so important in today's youth oriented fashion, magnetic stacking guides to simplify assembly and later assure stacked/wall mounted units' adherence, and the potential to free up precious limited closet space in a revolutionary new furniture style headwear cabinet that can be quickly assembled with minimal technical expertise or tools.

TABLE 1-3

| Group C, MODULAR | | | | | | | | | |
|---|---|---|---|---|---|---|---|---|---|
| Comparison Table of my embodiment's modular | My | PRIOR ART | | | | | | | |
| features to prior art's features | Embodiment | 1252816 | 2612590 | 3791528 | 48915826 | 5147120 | 5193683 | 6508021 B2 | 61585418 B2 |
| Contents Easily Accessible | ● | ● | | ● | | ● | | | ● |
| Stores More Than One Cap | ● | | | | | ● | | | ● |
| Easy Assembly | ● | | ● | ● | | ● | ● | | |

TABLE 1-3-continued

| Group C, MODULAR | | | | | | | | | |
|---|---|---|---|---|---|---|---|---|---|
| Comparison Table of my embodiment's modular features to prior art's features | My Embodiment | PRIOR ART 1252816 | 2612590 | 3791528 | 48915826 | 5147120 | 5193683 | 6508021 B2 | 61585418 B2 |
| Protects Contents from Dust | ● | ● | | | | ● | | | ● |
| Furniture Style Cabinet | ● | | | | | ● | | | |
| Stackable | ● | ● | ● | ● | ● | ● | ● | ● | ● |
| Sliding Drawer | ● | ● | | | | ● | | | |
| Does not take up closet space | ● | | | | | | | | ● |
| Contents are visible | ● | | | | | | | | |
| Wall Mountable | ● | | | | | | | | |
| Promotes Crown & Bill Shape Integrity | ● | | | | | | | | |
| Uniformly Adjustable Head Forms to Hat Sizes | ● | | | | | | | | |
| Fits into any décor | ● | | | | | | | | |
| Cabinet Lighting with Dimmer | ● | | | | | | | | |
| Transparent Door | ● | | | | | | | | |
| Magnetic Stacking Guides | ● | | | | | | | | |
| Pressure Contacts | ● | | | | | | | | |
| Insulation piercing Contacts | ● | | | | | | | | |
| Expandable Wall Mounting Track | ● | | | | | | | | |
| Mods slide together on Mounting track | ● | | | | | | | | |
| Door Tracks | ● | | | | | | | | |
| Quick Disconnect Technology | ● | | | | | | | | |

Prior Art Group D—Wall Mounts. This group of prior art consists of wall suspension devices. This feature is necessary to provide an easy way of mounting the storage units on walls as an alternative or additional configuration to the basic stacking feature. The entire prior art in this category, although utilizing various and differing devices, share this feature with my embodiment. U.S. Pat. No. 3,532,317 to Benjamin H. Adler (1970) is a suspension system to mount lighter objects such as letters to a wall. U.S. Pat. No. 3,669,035 to Milton J. Grossman (1972) is an easily assembled extruded shelving system. This prior art is sufficiently strong to support objects such as a storage system. However, this prior art also does not share any other features with my embodiment as it is specifically presented as a shelving system. U.S. Pat. No. 4,008,872 to Richard W. Thompson (1977) is a universal wall mounting system. This system utilizes a metal track that is embedded in a mount block which in turn mounts on the wall. This results in a wide gap between wall and the mounted module. My embodiment which does not use a mounting block allows the modules to hang closer to the wall and is less costly to produce. U.S. Pat. No. 5,050,832 to E. Desmond Lee (1991) is also a universal wall mounting system. It uses a mounting track and a c shaped bracket on each vertical side corner of the module facing the wall. This configuration requires that the modules have a cut out channel the length of the module to accommodate the mounting and the installation of the c shaped brackets on each module. This is complicated and labor intensive, driving up the manufacturing cost.

Table 1-4 compares the modular features of the prior art discussed above with the features of my embodiment. As is clearly depicted in the table, all 4 prior art patents are wall mounting devices and two can be easily assembled. However, none of the prior art in the table share all of the features with my embodiment. Furthermore, none of the prior art in this category shared any of the other features with my embodiment which are necessary to provide storage with built-in dimmable lighting, a transparent cantilevered door that opens and closes on door tracks for quick accessibility of contents in any ambient lighting conditions, adjustable head forms that variably adjust to the exact hat sizes to promote the shape integrity of the headwear's crowns, brims, or bills so important in today's youth oriented fashion, magnetic stacking guides to simplify assembly and later assure stacked units' adherence, and the potential to free up precious limited closet space in a revolutionary new furniture style headwear cabinet that can be quickly assembled with minimal technical expertise or tools.

TABLE 1-4

| Group D, WALL MOUNT | | | | | |
|---|---|---|---|---|---|
| Comparison Table of my embodiment's wall mount features to prior art's features | My Embodiment | PRIOR ART 3532317 | 36158035 | 4008872 | 5050832 |
| Contents Easily Accessible | ● | | | | |
| Stores More Than One Cap | ● | | | | |
| Easy Assembly | ● | | ● | | ● |
| Protects Contents from Dust | ● | | | | |
| Furniture Style Cabinet | ● | | | | |
| Stackable | ● | | | | |
| Sliding Drawer | ● | | | | |

TABLE 1-4-continued

| Group D, WALL MOUNT | | | | | |
|---|---|---|---|---|---|
| Comparison Table of my embodiment's wall mount | My | PRIOR ART | | | |
| features to prior art's features | Embodiment | 3532317 | 36158035 | 4008872 | 5050832 |
| Does not take up closet space | ● | | | | |
| Contents are visible | ● | | | | |
| Wall Mountable | ● | ● | ● | ● | ● |
| Promotes Crown & Bill Shape Integrity | ● | | | | |
| Uniformly Adjustable Head Forms to Hat Sizes | ● | | | | |
| Fits into any décor | ● | | | | |
| Cabinet Lighting with Dimmer | ● | | | | |
| Transparent Door | ● | | | | |
| Magnetic Stacking Guides | ● | | | | |
| Pressure Contacts | ● | | | | |
| Insulation piercing Contacts | ● | | | | |
| Expandable Wall Mounting Track | ● | | | | |
| Mods slide together on Mounting track | ● | | | | |
| Door Tracks | ● | | | | |
| Quick Disconnect Technology | ● | | | | |

Prior Art Group E—Stackable Guides. This group of prior art consists of guide mechanisms for stackable modules or containers. This feature is necessary to provide an easy way of stacking or mounting storage modules. The entire prior art in this category, although utilizing various and differing devices, share this feature with my embodiment. U.S. Pat. No. 2,561,561 to Joseph F. Cella (1951) is a stackable guide device that is installed at the four bottom corners of stackable crates which retract when the crate is on a flat surface and extend from the crate when the crate is lifted from the floor surface. It requires that the bottom of the crate have an open space and relies purely on gravity and the weight of the crates to keep the stack together. Therefore, this stacking system would not be possible with my embodiment. Furthermore, the magnetic stacking guides utilized in my embodiment simplify the assembly process and keep the stacked/wall mounted units firmly joined vertically and horizontally to insure structural stability and electrical-mechanical contact between units via the pressure electrical contacts for the low voltage lighting system. U.S. Pat. No. 4,757,910 to Thomas Box (1988) makes use of tapered top and bottom edges on beverage cases as a stacking guide system. This system also relies on gravity and the weight of the beverage crates to keep the stack together. The magnetic stacking guide system utilized in my embodiment is superior to this prior art primarily because it keeps the stacked units attached thus maintaining electrical connectivity for the dimmable lighting system throughout the module stacks both in a vertical stack and horizontally when the units are placed side by side or wall mounted.

Table 1-5 compares the stackable features of the prior art discussed above with the features of my embodiment. As is clearly depicted in the table, both prior art patents are stackable guiding devices that rely on gravity to keep the stacked crates together and do not have the capability of keeping the modules together horizontally as my embodiment does to ensure electrical continuity throughout the entire stack. Furthermore, neither of the prior art in this category shared any of the other features with my embodiment which are necessary to provide storage with built-in dimmable lighting, a transparent cantilevered door that opens and closes on door tracks for quick accessibility of contents in any ambient lighting conditions, adjustable head forms that variably adjust to the exact hat sizes to promote the shape integrity of the headwear's crowns, brims, or bills so important in today's youth oriented fashion, magnetic stacking guides to simplify assembly and later assure stacked units' adherence, and the potential to free up precious limited closet space in a revolutionary new furniture style headwear cabinet that can be quickly assembled with minimal technical expertise or tools.

TABLE 1-5

| Group E, STACKING GUIDES | | | |
|---|---|---|---|
| Comparison Table of my embodiment's stacking guides | My | PRIOR ART | |
| features to prior art's features | Embodiment | 2561561 | 4757910 |
| Contents Easily Accessible | ● | | |
| Stores More Than One Cap | ● | | |
| Easy Assembly | ● | | |
| Protects Contents from Dust | ● | | |
| Furniture Style Cabinet | ● | | |
| Stackable | ● | ● | ● |
| Sliding Drawer | ● | | |
| Does not take up closet space | ● | | |
| Contents are visible | ● | | |
| Wall Mountable | ● | | |
| Promotes Crown & Bill Shape Integrity | ● | | |
| Uniformly Adjustable Head Forms to Hat Sizes | ● | | |
| Fits into any décor | ● | | |
| Cabinet Lighting with Dimmer | ● | | |
| Transparent Door | ● | | |
| Magnetic Stacking Guides | ● | | |
| Pressure Contacts | ● | | |
| Insulation piercing Contacts | ● | | |
| Expandable Wall Mounting Track | ● | | |
| Mods slide together on Mounting track | ● | | |
| Door Tracks | ● | | |
| Quick Disconnect Technology | ● | | |

Prior Art Group F—Magnetic Coupling. This group of prior art consists of magnetic coupling or retention methods for everything from dental retainers to diagnostic tool connectors. U.S. Pat. No. 2,678,228 to Robert F. Gerhardt (1954) diagnostic instrument magnetic device that connects the instrument to a handle. This is a very specific use for a magnetic coupling device. It is very small and has little in common with my embodiment. U.S. Pat. No. 4,824,371 to Allan S. Deutsch and Barry L. Musikant (1989), U.S. Pat. No. 4,997,372 to James R. Shiner and Roger E. Rule (1991), and U.S. Pat. No. 4,431,419 to Leonard L. Portnoy (1984) are magnetic dental retaining devices. These three prior art inventions share no other common features with my embodiment. U.S. Pat. No. 5,425,763 to Hartmut Steinmann (1995) is a magnetic fastening system for use with small prostheses such as ears or noses. This prior art also has a very specific feature and shares no other features with my embodiment.

strong connection between units after assembly, which is required for the dimmable lighting system's pressure contacts to maintain proper electrical connection. Furthermore, none of the prior art in this category shared any of the other features with my embodiment which are necessary to provide storage with built-in dimmable lighting, a transparent cantilevered door that opens and closes on door tracks for quick identification and accessibility of contents in any ambient lighting conditions, adjustable head forms that variably adjust to the exact hat sizes to promote the shape integrity of the headwear's crowns, brims, or bills so important in today's youth oriented fashion, and the potential to free up precious limited closet space in a revolutionary new furniture style headwear cabinet that can be quickly assembled with minimal technical expertise or tools.

TABLE 1-6

Group F, MAGNETIC COUPLING

| Comparison Table of my embodiment's magnetic coupling features to prior art's features | My Embodiment | PRIOR ART 2678228 | 4431419 | 4824371 | 4997372 | 5425763 | 7423506 B2 |
|---|---|---|---|---|---|---|---|
| Contents Easily Accessible | ● | | | | | | |
| Stores More Than One Cap | ● | | | | | | |
| Easy Assembly | ● | ● | | | | | |
| Protects Contents from Dust | ● | | | | | | |
| Furniture Style Cabinet | ● | | | | | | |
| Stackable | ● | | | | | | |
| Sliding Drawer | ● | | | | | | |
| Does not take up closet space | ● | | | | | | |
| Contents are visible | ● | | | | | | |
| Wall Mountable | ● | | | | | | |
| Promotes Crown & Bill Shape Integrity | ● | | | | | | |
| Uniformly Adjustable Head Forms to Hat Sizes | ● | | | | | | |
| Fits into any décor | ● | | | | | | |
| Cabinet Lighting with Dimmer | ● | | | | | | |
| Transparent Door | ● | | | | | | |
| Magnetic Stacking Guides | ● | ● | ● | ● | ● | ● | ● |
| Pressure Contacts | ● | | | | | | |
| Insulation piercing Contacts | ● | | | | | | |
| Expandable Wall Mounting Track | ● | | | | | | |
| Mods slide together on Mounting track | ● | | | | | | |
| Door Tracks | ● | | | | | | |
| Quick Disconnect Technology | ● | | | | | | |

U.S. Pat. No. 7,423,506 B2 to Atushi Terasaki (2008) is a special annular device consisting of 3 identical magnetic arcs that adhere to one another to form a circle for special purposes. This device has no other features in common with my embodiment. The magnetic stacking guide feature in my embodiment incorporates the stacking guide feature to simplify assembly with the magnetic coupling characteristic that occurs when opposite poled magnets come together to keep the modules together after assembly. This ensures good electrical connections between modules via the pressure electrical contacts for the dimmable lighting system. The entire prior art in this category, although utilizing various and differing methods and for unrelated purposes, do share the magnetic coupling feature with my embodiment.

Table 1-6 compares the magnetic coupling features of the prior art discussed above with the features of my embodiment. As the table clearly shows all prior art patents utilize the magnetic feature. They use the coupling force created when opposing magnetic poles come together to keep instrument heads on handles, dentures and prostheses in place and for other very specialized uses. None of the prior art, however, incorporates the module stacking guides with the magnetic feature to make assembly easier and to ensure a Prior Art Group G—Pressure Contacts. This group of prior art consists of pressure contacts, self wiping electrical connecting devices, or spring loaded pin connectors, which extend out to a termination plate to make electrical connection instead of entering a female connector, primarily used for circuit boards. U.S. Pat. No. 4,548,451 to Garry M. Benarr, Terry A. Burns, and William J. Walker (1985) is a pinless self wiping connector for the manufacture of densely populated circuit boards. This is a push pull connector with a very specific use. It is very small and has little in common with my embodiment. U.S. Pat. No. 4,813,129 to Marcos Karnezos (1989) and U.S. Pat. No. 5,147,208 to Gary A. Bachler (1992) are both systems of compressed electrical contacts for use on PC boards and integrated circuit boards. Like the prior art these two patents are extremely small and designed with a specific purpose. These two prior art inventions share no other common features with my embodiment. U.S. Pat. No. 5,855,063 to Chris M. Schreiber (1999) is a contact system consisting of metallic depressions and corresponding protrusions for use on circuit boards. This patent is designed for a very specific purpose and basically has very little in common with my embodiment. The pressure contacts feature in my embodiment works hand in hand with the magnetic stacking guide feature to simplify assembly when the magnetic coupling characteristic that occurs when opposite poled magnets come together to keep the modules together after assembly. This ensures good electrical connections between modules via the pressure electrical contacts for the dimmable lighting system. The entire prior art in this category, although utilizing various and differing methods and for unrelated purposes, do share some form of self wiping electrical contacts system with my embodiment. However, all prior art in this category is extremely small and specifically designed for integrated circuit boards.

Table 1-7 compares the pressure contacts features of the prior art discussed above with the features of my embodiment. As the table clearly shows all prior art patents utilize the self wiping contact (pressure contacts) feature. They use the self wiping contacts for PC and integrated circuits where space is at premium. Therefore, the primary purpose for this design is that the contacts can be made very small. However, none of the prior art incorporates the pressure contacts to automatically connect the dimmable lighting system during assembly. In conclusion, none of the prior art in this category shared any of the other features with my embodiment which are necessary to provide storage with built-in dimmable lighting, a transparent cantilevered door that opens and closes on door tracks for quick identification and accessibility of contents in any ambient lighting conditions, adjustable head forms that variably adjust to the exact hat sizes to promote the shape integrity of the headwear's crowns, brims, or bills so important in today's youth oriented fashion, and the potential to free up precious limited closet space in a revolutionary new furniture style headwear cabinet that can be quickly assembled with minimal technical expertise or tools.

TABLE 1-7

| Group G, PRESSURE CONTACTS | | | | | |
|---|---|---|---|---|---|
| Comparison Table of my embodiment's pressure contacts features to prior art's features | My Embodiment | PRIOR ART 4548451 | 4813129 | 5147208 | 5855063 |
| Contents Easily Accessible | ● | | | | |
| Stores More Than One Cap | ● | | | | |
| Easy Assembly | ● | | | | |
| Protects Contents from Dust | ● | | | | |
| Furniture Style Cabinet | ● | | | | |
| Stackable | ● | | | | |
| Sliding Drawer | ● | | | | |
| Does not take up closet space | ● | | | | |
| Contents are visible | ● | | | | |
| Wall Mountable | ● | | | | |
| Promotes Crown & Bill Shape Integrity | ● | | | | |
| Uniformly Adjustable Head Forms to Hat Sizes | ● | | | | |
| Fits into any décor | ● | | | | |
| Cabinet Lighting with Dimmer | ● | | | | |
| Transparent Door | ● | | | | |
| Magnetic Stacking Guides | ● | | | | |
| Pressure Contacts | ● | ● | ● | ● | ● |
| Insulation piercing Contacts | ● | | | | |
| Expandable Wall Mounting Track | ● | | | | |
| Mods slide together on Mounting track | ● | | | | |
| Door Tracks | ● | | | | |
| Quick Disconnect Technology | ● | | | | |

Prior Art Group H—Insulation piercing Contacts. This group of prior art consists of insulation piercing contacts which are designed to pierce through the insulation of a wire to secure an electrical contact. U.S. Pat. No. 1,956,018 to Charles E. Gilbert (1934) and U.S. Pat. No. 4,243,287 to Donald F. Smith and Michael J. Ostrelich (1981) are electrical plugs designed to accept an insulated two conductor electrical cord which is in turn penetrated by sharp projections making proper electrical connections when the plugs are reassembled. These are very specific patents for the repair of common A.C. plugs and bear very little in common with my embodiment. U.S. Pat. No. 2,678,429 to Charles W. Abbott (1954) is also an electrical plug repair method. This patent however requires that the insulated wires be individually penetrated by crimping before the plug is reassembled. Like the prior art, this patent has a very specific design and has very little in common with my embodiment. U.S. Pat. No. 2,873,434 to Raymond F. Dunn (1959) and U.S. Pat. No. 4,288,918 are both universal methods of crimping an insulated wire onto an electrical conductor. They both require a special crimping tool to form the connector around the wire and penetrate the wire. These patents are designed for a very specific purpose and basically have very little in common with my embodiment. U.S. Pat. No. 4,231,632 to Jean-Marie Badoz and Daniel Merceron (1980) is a specially designed connector that uses insulation piercing technology to make the electrical connection and secure the wire to the connector in the manufacturing process. This patent has very little in common with my embodiment. U.S. Pat. No. 4,715,825 to Bob Mousissie and Hubertus B. Libregts (1987) is a special purpose connector that uses insulation piercing technology to make contact inside the housing and a rounded contact outside of the housing to make contact with a matching contact. This patent is very specific and has very little in common with my embodiment. The insulation piercing contact technology feature in my embodiment is designed to automatically establish electrical connections throughout each unit as it is being assembled by the end user. The entire prior art in this category, although utilizing various and differing methods and for unrelated purposes, do share some form of insulation piercing electrical technology with my embodiment. However, all prior art in this category is specifically designed for AC plugs or special manufacturing purposes.

Table 1-8 compares the insulation piercing contact feature of the prior art discussed above with the features of my embodiment. As the table clearly shows all prior art patents utilize insulation piercing techniques to establish electrical connections. They use the insulation piercing contact technology to repair AC plugs and in the manufacturing of special purpose connectors. However, none of the prior art incorporates the insulation piercing contact technology to automatically make electrical connections throughout each unit as it is assembled by the end user. In conclusion, none of the prior art in this category shared any of the other features with my embodiment which are necessary to provide storage with built-in dimmable lighting, a transparent cantilevered door that opens and closes on door tracks for quick identification and accessibility of contents in any ambient lighting conditions, adjustable head forms that variably adjust to the exact hat sizes to promote the shape integrity of the headwear's crowns, brims, or bills so important in today's youth oriented fashion, and the potential to free up precious limited closet space in a revolutionary new furniture style headwear cabinet that can be quickly assembled with minimal technical expertise or tools.

TABLE 1-8

| Group H, INSULATION PIERCING CONTACTS | | | | | | | | |
|---|---|---|---|---|---|---|---|---|
| Comparison Table of my embodiment's insulation piercing | | PRIOR ART | | | | | | |
| contacts features to prior art's features | My Embodiment | 2678429 | 2873434 | 4231632 | 4243287 | 4288918 | 4715825 | 1956018 |
| Contents Easily Accessible | ● | | | | | | | |
| Stores More Than One Cap | ● | | | | | | | |
| Easy Assembly | ● | | | | | | | |
| Protects Contents from Dust | ● | | | | | | | |
| Furniture Style Cabinet | ● | | | | | | | |
| Stackable | ● | | | | | | | |
| Sliding Drawer | ● | | | | | | | |
| Does not take up closet space | ● | | | | | | | |
| Contents are visible | ● | | | | | | | |
| Wall Mountable | ● | | | | | | | |
| Promotes Crown & Bill Shape Integrity | ● | | | | | | | |
| Uniformly Adjustable Head Forms to Hat Sizes | ● | | | | | | | |
| Fits into any décor | ● | | | | | | | |
| Cabinet Lighting with Dimmer | ● | | | | | | | |
| Transparent Door | ● | | | | | | | |
| Magnetic Stacking Guides | ● | | | | | | | |
| Pressure Contacts | ● | | | | | | | |
| Insulation piercing Contacts | ● | ● | ● | ● | ● | ● | ● | ● |
| Expandable Wall Mounting Track | ● | | | | | | | |
| Mods slide together on Mounting track | ● | | | | | | | |
| Door Tracks | ● | | | | | | | |
| Quick Disconnect Technology | ● | | | | | | | |

Prior Art Group I—Door Tracks. This group of prior art consists of various types of overhead sectional and cantilevered door systems on door tracks. U.S. Pat. No. 2,686,926 to Clifford A. Schacht and Flay Downs Crosswell (1954); U.S. Pat. No. 2,991,496 to Cecil R. Wolf et al. (1961); U.S. Pat. No. 2,534,641 to Clarence J. Veigel (1950); U.S. Pat. No. 5,718,533 to Willis Mullet et al. (1998); and U.S. Pat. No. 5,235,724 to Donald E. Perrin (1993) are all overhead garage door systems or enhancements for these doors. The cantilevered door in my embodiment is made of transparent material or glass and is considerably smaller than the prior art. Although, the entire prior art in this category utilizes various and differing methods of overhead door systems, it does share cantilevered and sectional door operational fundamentals with my embodiment. However, all prior art in this category is specifically designed for overhead garage doors.

Table 1-9 compares the door track features of the prior art discussed above with the features of my embodiment. As the table clearly shows all prior art patents utilize door tracks for overhead or cantilevered garage doors. However, none of the prior art in this category shared any of the other features with my embodiment which are necessary to provide storage with built-in dimmable lighting, a transparent cantilevered door that opens and closes on door tracks for quick identification and accessibility of contents in any ambient lighting conditions, adjustable head forms that variably adjust to the exact hat sizes to promote the shape integrity of the headwear's crowns, brims, or bills so important in today's youth oriented fashion, and the potential to free up precious limited closet space in a revolutionary new furniture style headwear cabinet that can be quickly assembled with minimal technical expertise or tools.

TABLE 1-9

| Group I, DOOR TRACKS | | | | | | |
|---|---|---|---|---|---|---|
| Comparison Table of my embodiment's door tracks features to | | PRIOR ART | | | | |
| prior art's features | My Embodiment | 26815826 | 2991496 | 2534641 | 5718533 | 5235724 |
| Contents Easily Accessible | ● | | | | | |
| Stores More Than One Cap | ● | | | | | |
| Easy Assembly | ● | | | | | |

TABLE 1-9-continued

| Group I, DOOR TRACKS | | | | | | |
|---|---|---|---|---|---|---|
| Comparison Table of my embodiment's door tracks features to | | PRIOR ART | | | | |
| prior art's features | My Embodiment | 26815826 | 2991496 | 2534641 | 5718533 | 5235724 |
| Protects Contents from Dust | ● | | | | | |
| Furniture Style Cabinet | ● | | | | | |
| Stackable | ● | | | | | |
| Sliding Drawer | ● | | | | | |
| Does not take up closet space | ● | | | | | |
| Contents are visible | ● | | | | | |
| Wall Mountable | ● | | | | | |
| Promotes Crown & Bill Shape Integrity | ● | | | | | |
| Uniformly Adjustable Head Forms to Hat Sizes | ● | | | | | |
| Fits into any décor | ● | | | | | |
| Cabinet Lighting with Dimmer | ● | | | | | |
| Transparent Door | ● | | | | | |
| Magnetic Stacking Guides | ● | | | | | |
| Pressure Contacts | ● | | | | | |
| Insulation piercing Contacts | ● | | | | | |
| Expandable Wall Mounting Track | ● | | | | | |
| Mods slide together on Mounting track | ● | | | | | |
| Door Tracks | ● | ● | ● | ● | ● | ● |
| Quick Disconnect Technology | ● | | | | | |

SUMMARY

In accordance with one embodiment the CapPalace is a storage enclosure for baseball style caps and other headwear designed to fit into any modern interior design thus freeing up closet space. For easy viewing and accessibility of contents this system has built-in low voltage dimmable lighting operated manually, by remote control, Blue Tooth technology or cell phone applications, a transparent cantilevered door located at the front of the CapPalace that can be operated manually, by remote control, by Blue Tooth technology or by cell phone applications, that opens and closes on door tracks, and a sliding drawer with a plurality of head forms mounted on it. Assembly of units is made easier by the use of insulation piercing electrical contacts that are strategically placed on unassembled unit walls to match insulated wires on abutting unit walls which, automatically, establish electrical continuity within the unit during the assembly when the insulation piercing contacts pierce through the insulation of the corresponding wires as the wall screws are torqued down. Quick connect/disconnect hardware on unassembled walls aid the user during assembly by keeping the units loosely together until the walls are screwed in place. System installation of several units is simplified by use of externally placed pressure electrical contacts on top, bottom and sides of the enclosures that create electrical continuity when enclosures are stacked or placed in a side by side configuration on the floor or mounted on a wall. The magnetic stacking guides externally placed on top, bottom and sides of the enclosure ensure that the units adhere tightly to each other resulting in good electrical continuity between units. Adjustable head forms can be quickly adjusted to exact hat sizes with an Allen wrench.

DRAWINGS—FIGURES

In the drawings, closely related figures have the same number but different alphabetic suffices.

FIGS. 20A and 20C the side and top views of the head form.

FIG. 20B shows the bottom of the head form.

Figure 21A:
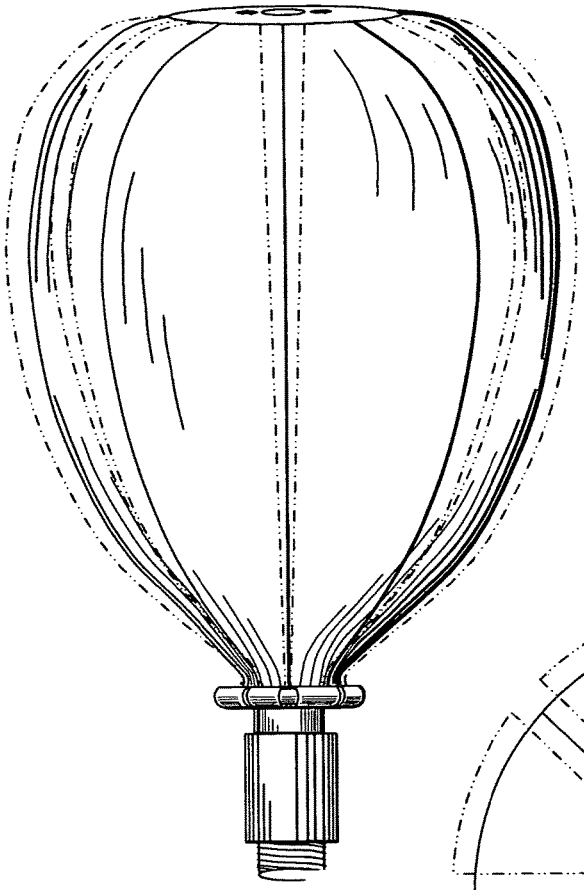
Figure 21C:
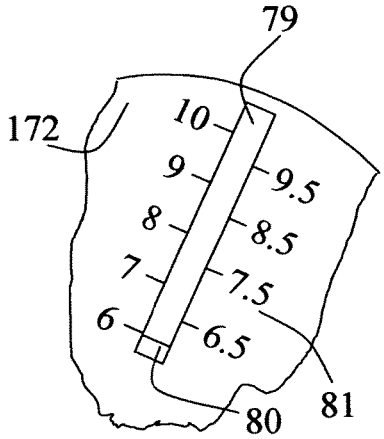
Figure 21B:
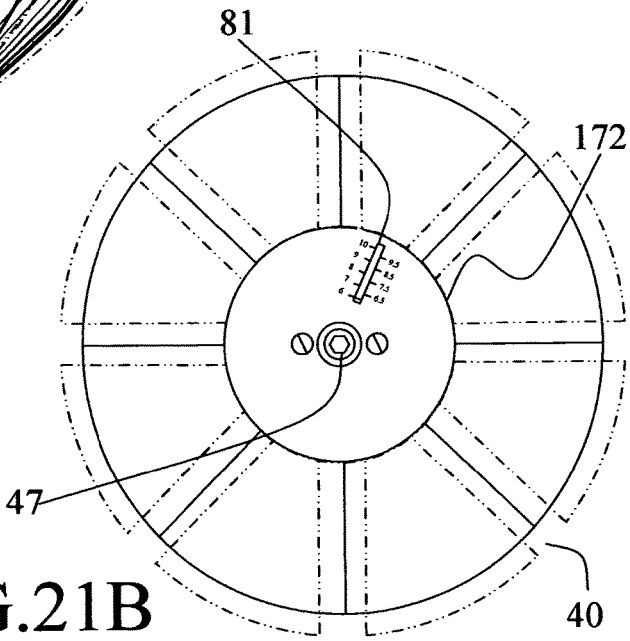

FIGS. 21A and 21B show the side and top views of the head form when adjusted.

FIG. 21C shows the hat size indicator.

Figure 22A:
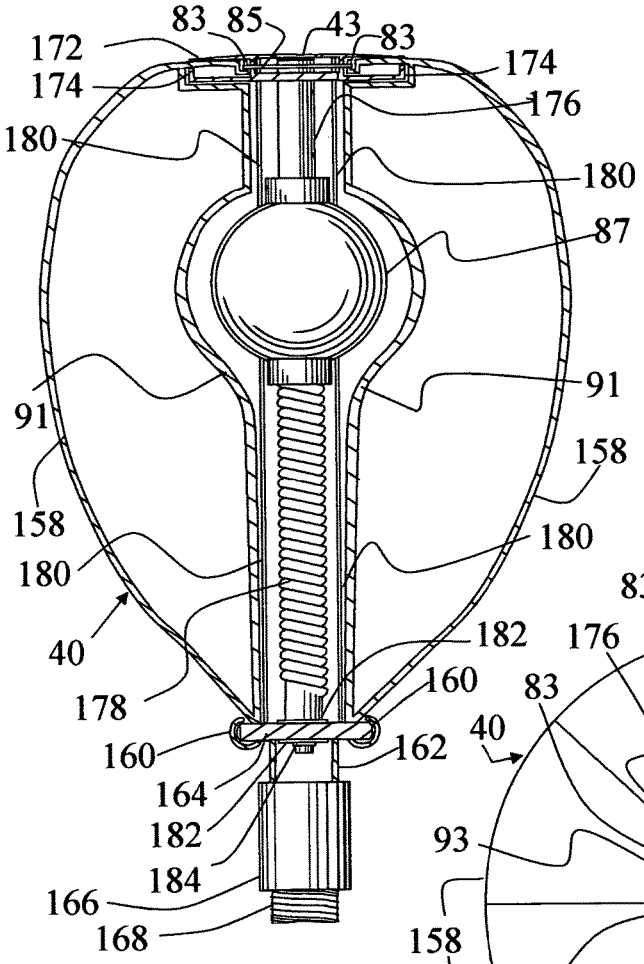
Figure 22C:
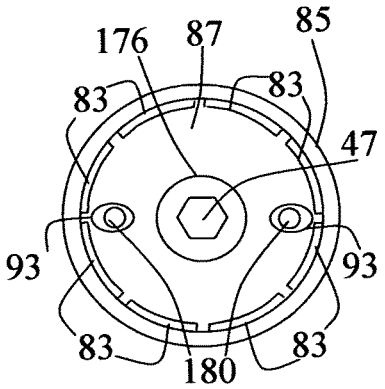
Figure 22B:
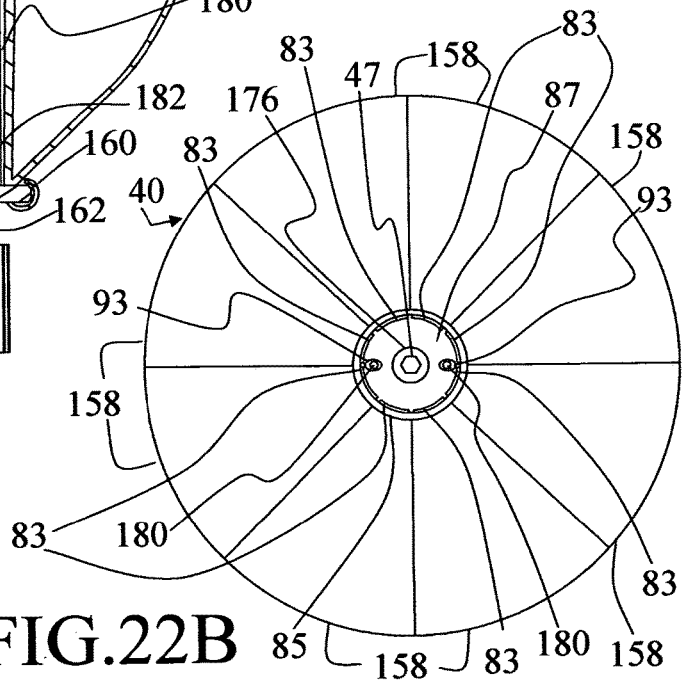

FIGS. 22A to 22C show the head form adjustment mechanism.

FIGS. 23A and 23B show the head form adjustment mechanism in the extended position.

FIG. 23C Shows an expanded view of the Ball

FIG. 24A and FIG. 24B show the head form adjustment from small size to largest size.

DRAWINGS—REFERENCE NUMERAL

30 Cap Storage Cabinet (CapPalace)
32 Magnetic Stacking Guide (Female)
33 Magnetic Stacking Guide (Male)
34 Flush Electrical Contact Assembly
35 Pressure Contact Electrical Assembly
36 Flush Electrical Contact
37 Magnet
38 Door Handle
40 Adjustable Head Form
41 Cap Screw
42 Adjustable Head Form Mounting Stem
43 Access Hole
44 Door
45 Door Wheel Channel
46 Base
47 hexagonal opening (for Allen wrench)
49 Base with Power Supply
52 Screw
53 Wall Mount Frame
54 Wall Mounting Cabinet Attachment
55 Bracket Screws
56 Drawer Assembly
58 Drawer Handle
60 Wall Mountable Power Supply
62 Wall Mountable Power Supply Dimmer/On/Off Control
64 Stackable Power Supply
66 Stackable Power Supply Dimmer/On/Off Control
68 Power Cord
70 Pressure Electrical Contact Assembly
72 Screw Hole
74 Left End of Wall Mount Frame
76 Right End of Wall Mount Frame
77 Wall Mount Spacer Assembly
78 Rear Side of Flush Electrical Contact
79 Aperture
80 Hat Size Indicator
81 Hat Size Scale
82 Conductor
83 Segment Lip
84 Three Way Two Wire Quick Disconnect Junction Unit
85 Elastic Band
86 Quick Disconnect Wire Insertion Opening
87 Ball
88 Insulation Ring
89 Wire Release Hole
90 Pressure Electrical Contact
91 Sloping Surface (of head form segment)
92 Prssure Contact Insulation Ring Rear
93 Guide Hole (On Cap)
94 Pressure Contact Rear Terminal
96 Two Stranded Insulated Conductor Tape
98 Wire Tape Surface Contact
100 Insulation Piercing Contact
102 Bolt for Male Magnetic Guide Insert
104 Magnetic Guide Insert
106 Magnetic Guide Ridge
108 Magnetic Guide Retainer Ring
110 Magnetic Guide Retainer Hinge
112 Magnetic Guide Retainer Ring Groove
114 Magnetic Guide Retainer Ring Flange
116 Securing Hook
118 Magnetic Stacking Guide Cup Hole
120 Locking bolt
121 Locking Bolt Detent
122 Locking bolt Receptor
123 Magnet
124 Door Wheel
125 Door Wheel Shaft In Partial Depressed Position
126 LED Assembly
127 Door Wheel Shaft Spring
128 Top Panel
129 Door Wheel in Partial Depressed Position
130 Rear Panel
132 Screw Hole
136 Left Side Panel
137 Right Side Panel
138 Drawer Groove
140 Bottom Panel
142 Head Form Screw Hole
144 Access Hole
146 Top Drawer Assembly
148 Bottom Drawer Assembly
150 Rear Lip
154 Drawer Rail (mounted on top drawer assembly)
155 Drawer Rail (mounted on bottom drawer assembly)
156 Electrical Contact Clearance Opening
158 Head Form Segment
160 Segment Pivot
162 Head Form Support
164 Pivot Anchor Ring
166 Head Form Screw Mount
168 Mounting Screw
170 Ball Guide Screw Hole
172 Cap
174 Stop
176 Worm Screw Shaft
178 Worm Screw
179 Worm Screw Threaded Hole
180 Ball Guide
181 Ball Guide Hole (On Ball)
182 Teflon Washer
184 Retainer Ring
186 Electrical Contact Clearance Opening
188 Screw Hole

DETAILED DESCRIPTION

FIGS. 1, 2A to 2B, 3, 4, 5, 6 to 6A, 7, 8A to 8B, 9A to 9D, 10A to 10C, 11A to 11C, 12A to 12D, 13 to 14, 15A to 15E, 16 to 18, 19A to 19F, 20A to 20C, 21A to 21C, 22A to 22C, 23A to 23C, and 24A to 24B—

Preferred Embodiment

Figure 1:
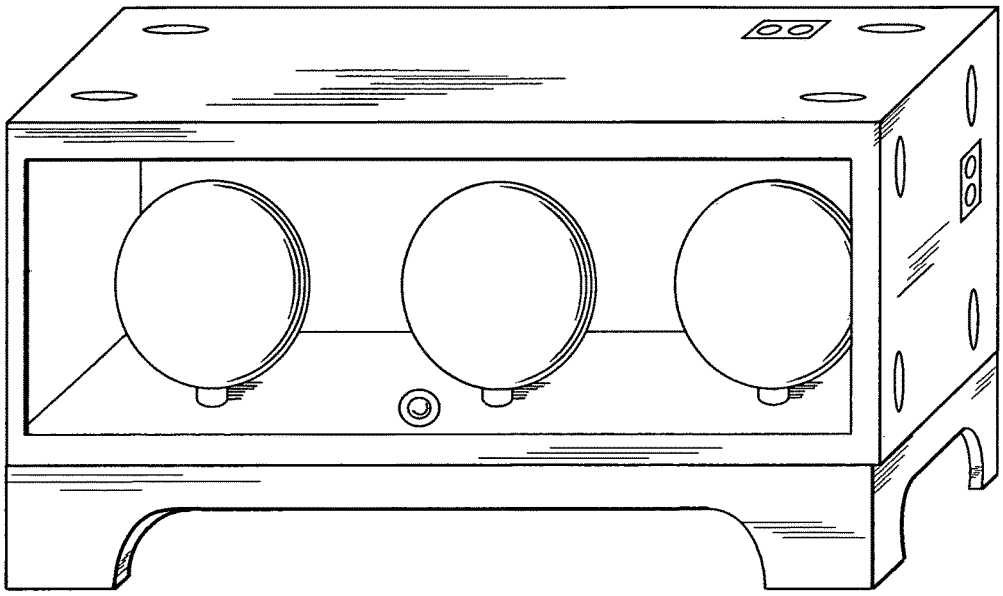
FIG. 1 shows the cabinet (CapPalace) with no reference numbers.
Figure 2A:
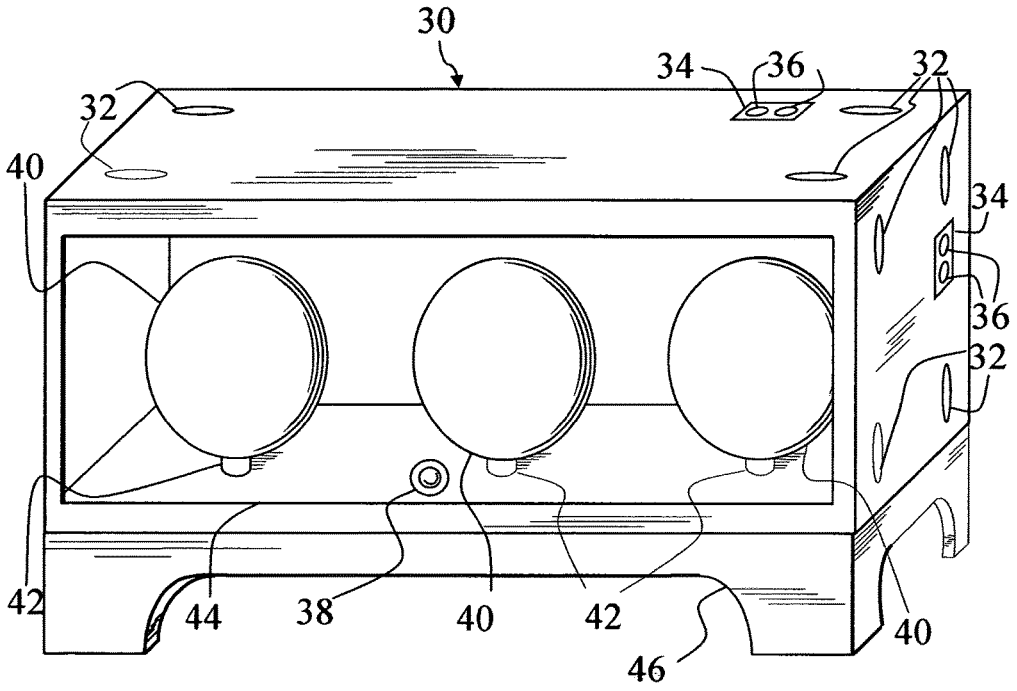
FIGS. 2A and 2B show the cabinet with door closed and open respectively including reference numbers.
Figure 2B:
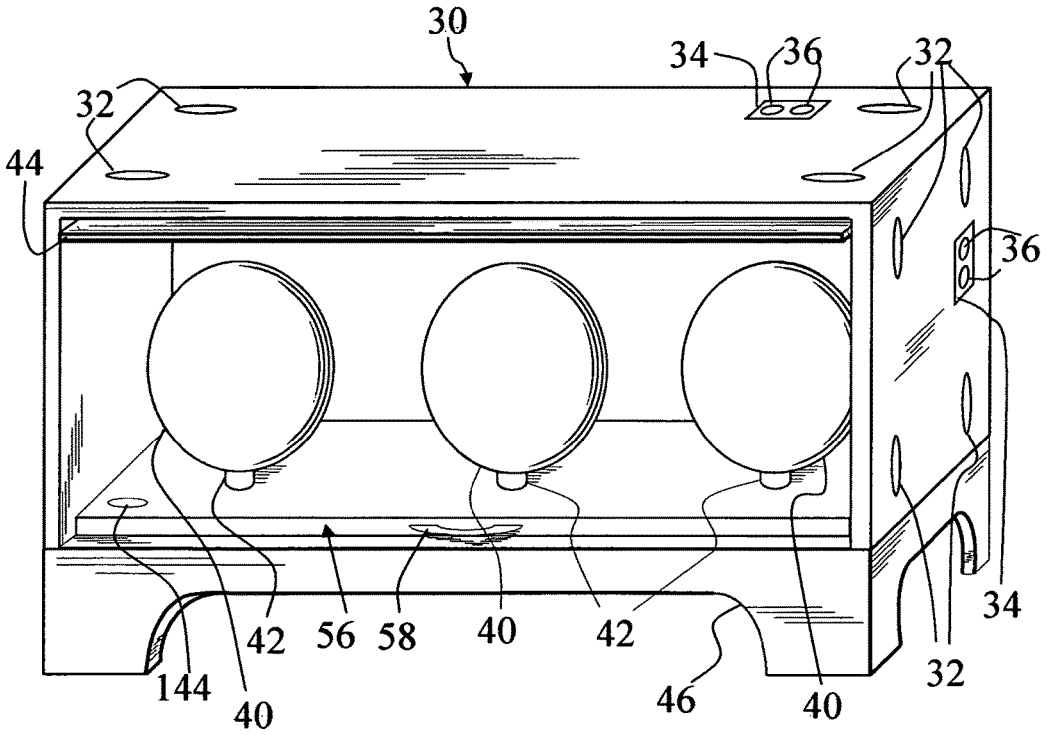
Figure 3:
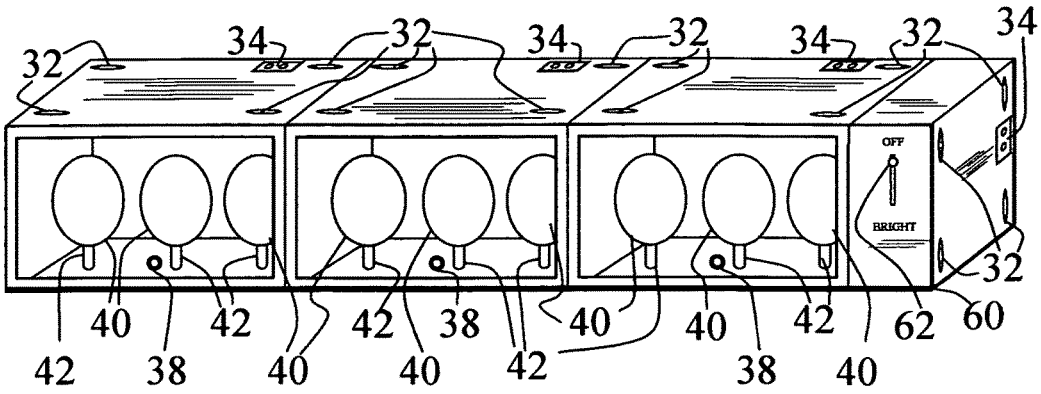
FIG. 3 shows the cabinet system in the wall mounted configuration.
Figure 4:
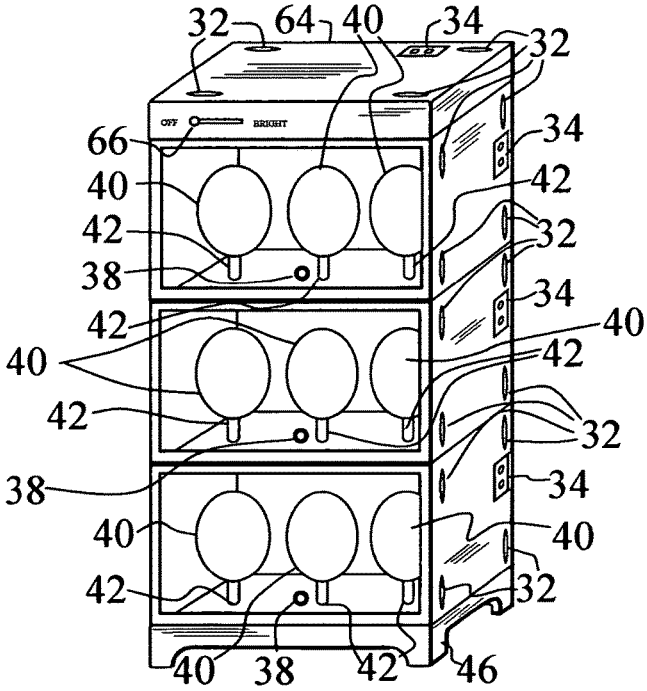
FIG. 4 shows the cabinet system in the stacked configuration.
Figure 5:
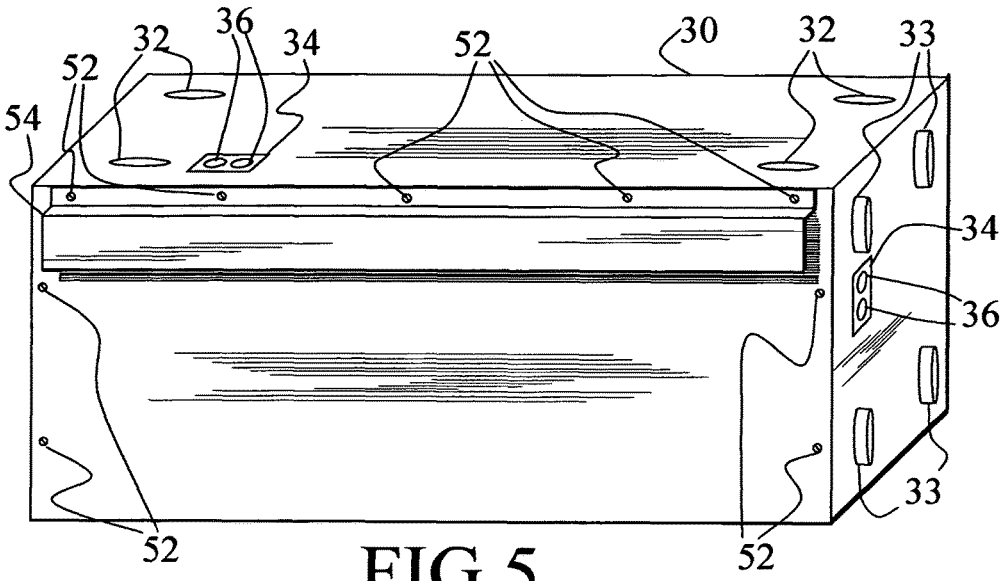
FIG. 5 is the rear side of the cabinet.
Figure 6:
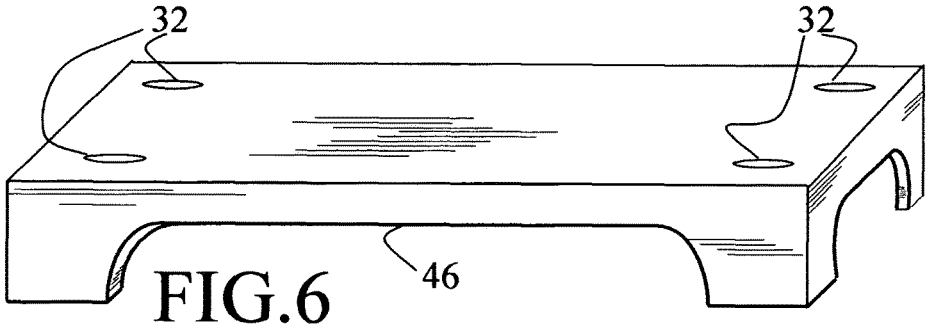
FIG. 6 shows the base unit
Figure 6A:
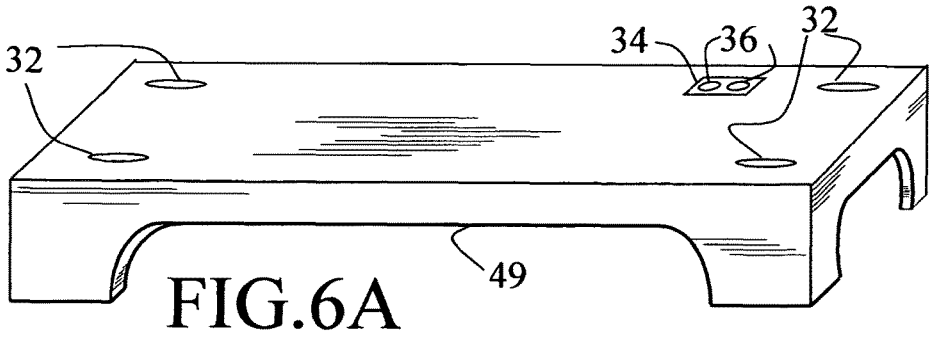
FIG. 6A shows the base unit with power supply.
Figure 7:
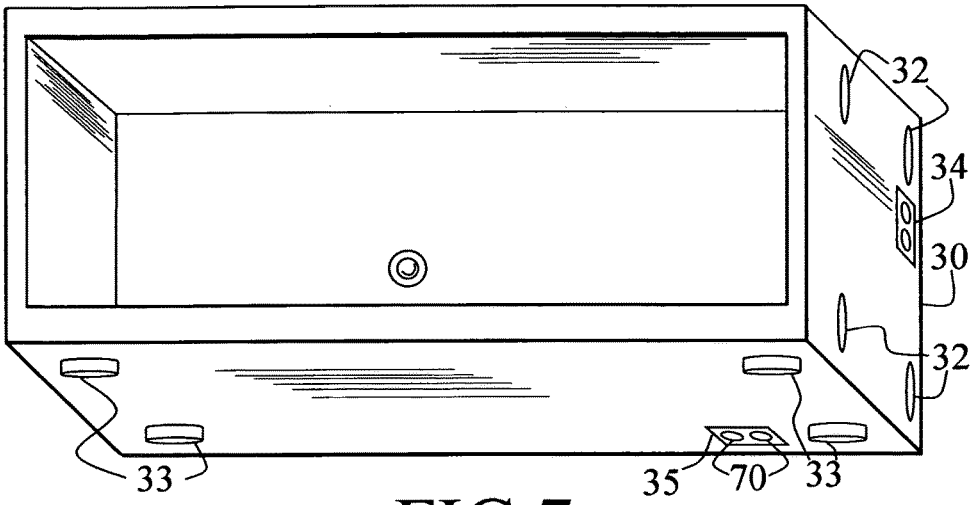
FIG. 7 shows the cabinet from a lower perspective to reveal the external bottom.
Figure 8A:
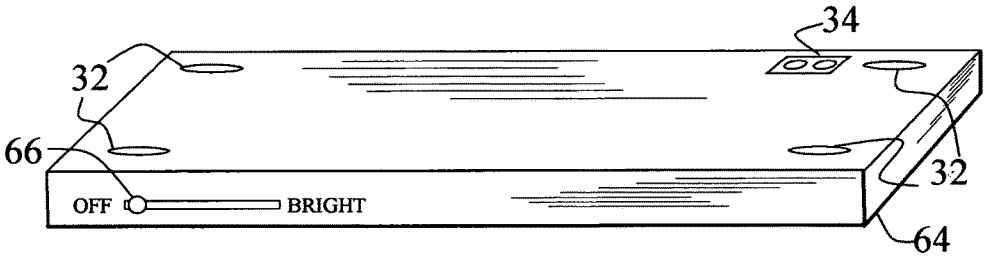
FIGS. 8A and 8B show the stackable power supply from different perspectives.
Figure 8B:
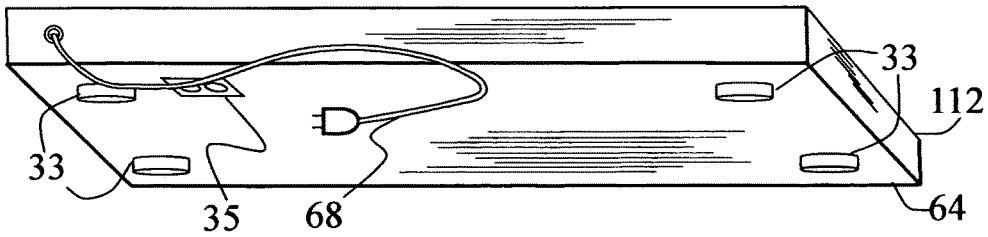
Figure 9A:
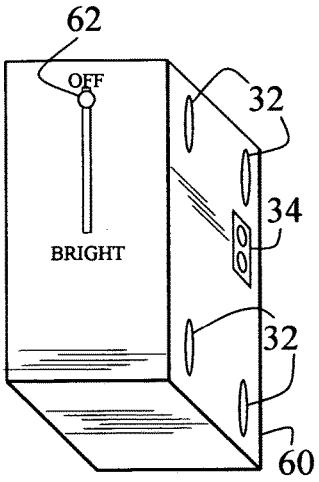
FIGS. 9A to 9C show the wall mountable power supply from different perspectives.
Figure 9B:
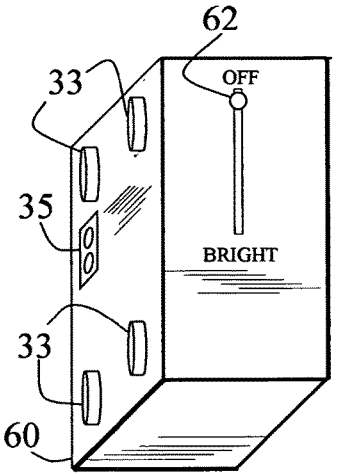
Figure 9C:
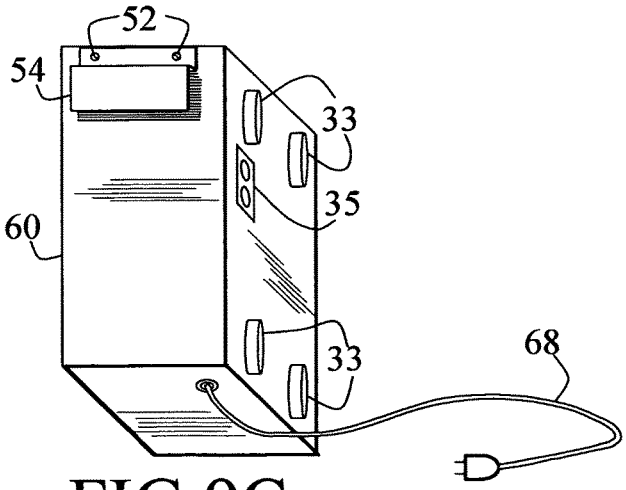
Figure 9D:
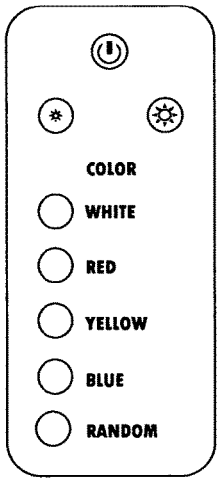
FIG. 9D shows the remote control for the power supply
Figure 10A:
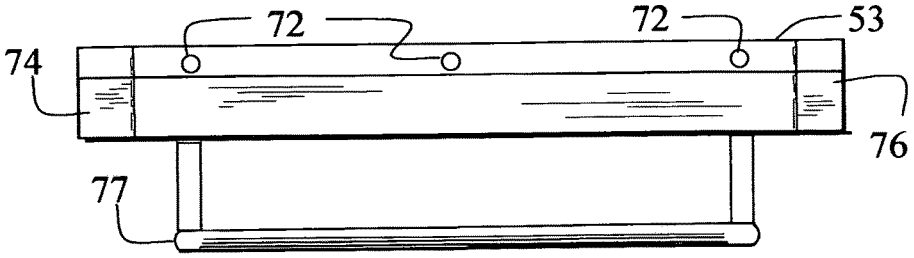
FIGS. 10A to 10C show the wall mounting rail from different perspectives.
Figure 10B:
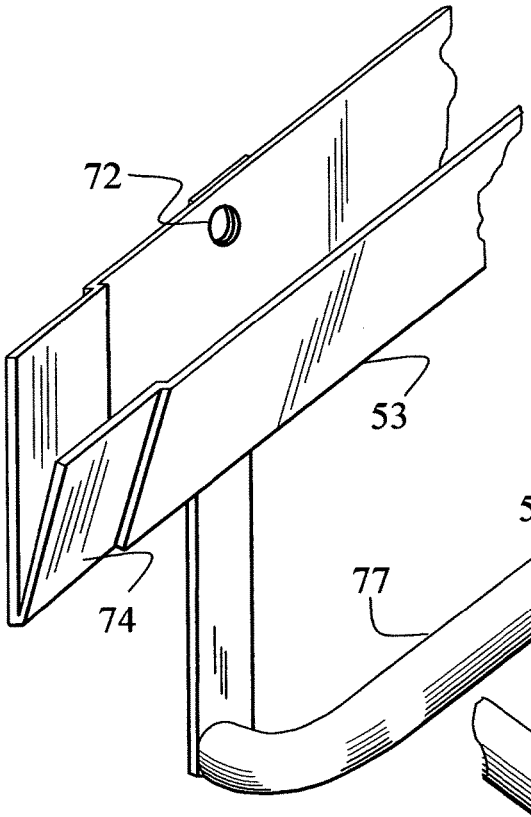
Figure 10C:
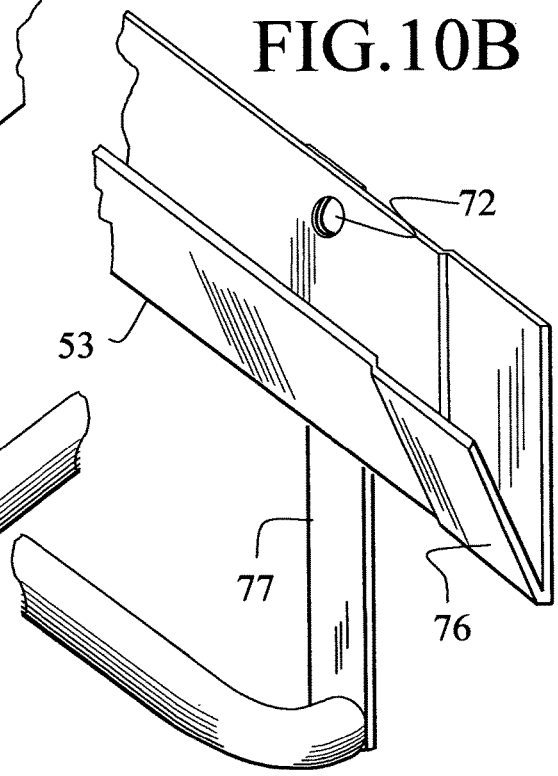
Figure 11A:
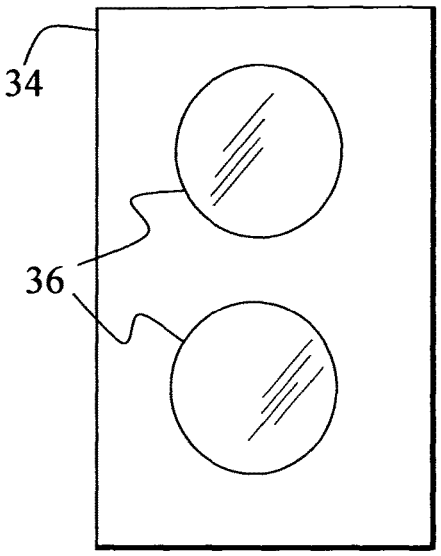
FIGS. 11A to 11C show the receiving (flush) side of the pressure contacts plate from different perspectives.
Figure 11B:
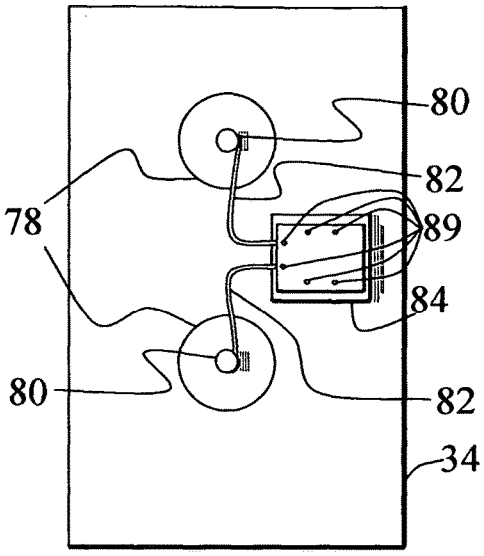
Figure 11C:
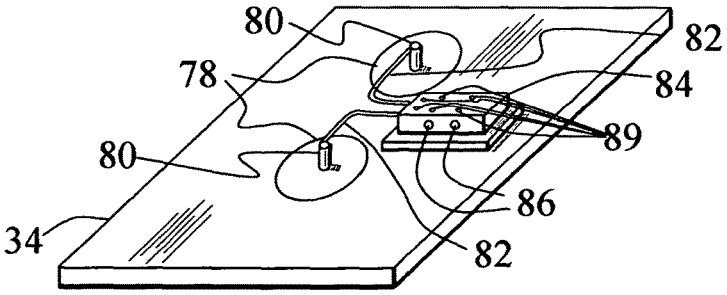
Figure 12A:
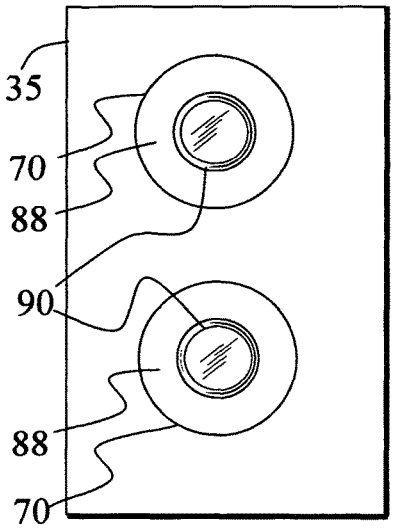
FIGS. 12A to 12D show the pressure (spring loaded) side of the pressure contacts from different perspectives.
Figure 12B:
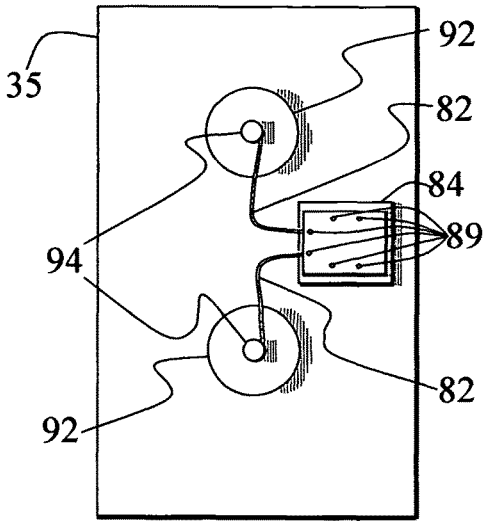
Figure 12C:
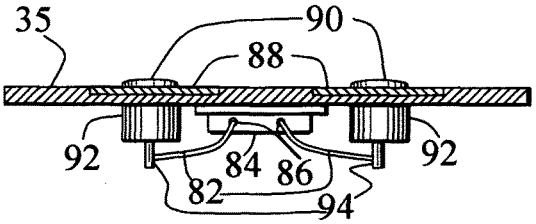
Figure 12D:
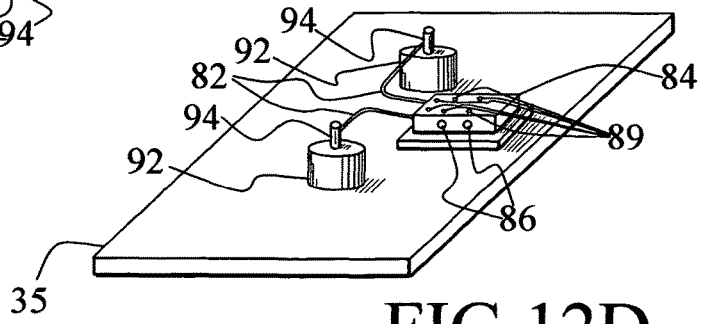
Figure 13:
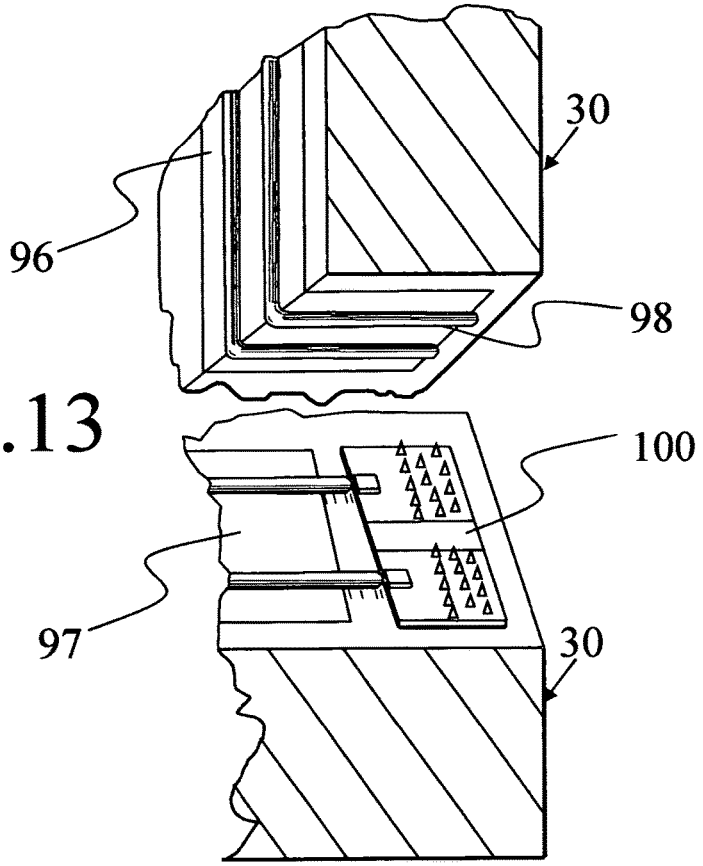
FIG. 13 is an expanded view of the insulation piercing contacts and corresponding insulated wires as they would appear on the cabinet walls.
Figure 14:
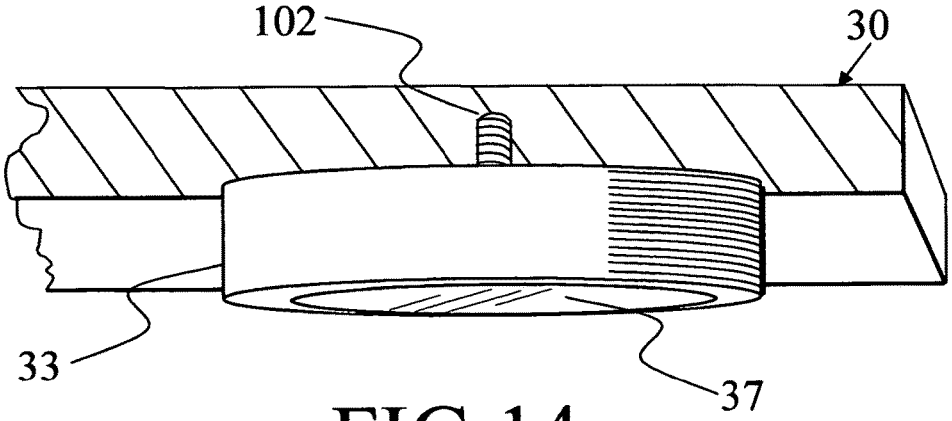
FIG. 14 shows the male side of the magnetic guides.
Figure 15A:
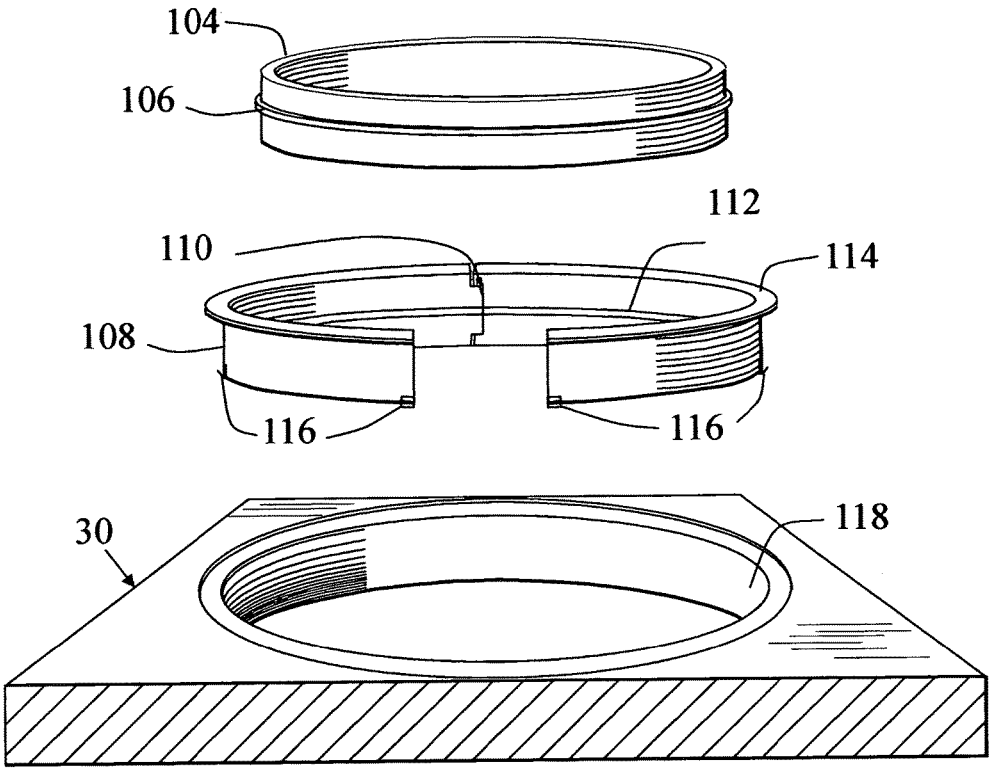
FIGS. 15A and 15B show the female side of the magnetic guides in the functioning position
Figure 15B:
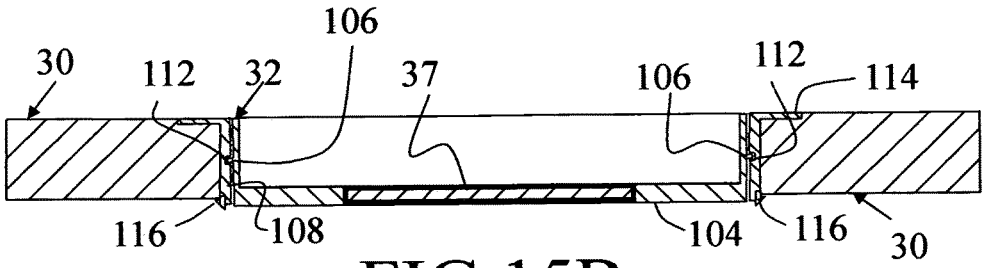
Figure 15C:
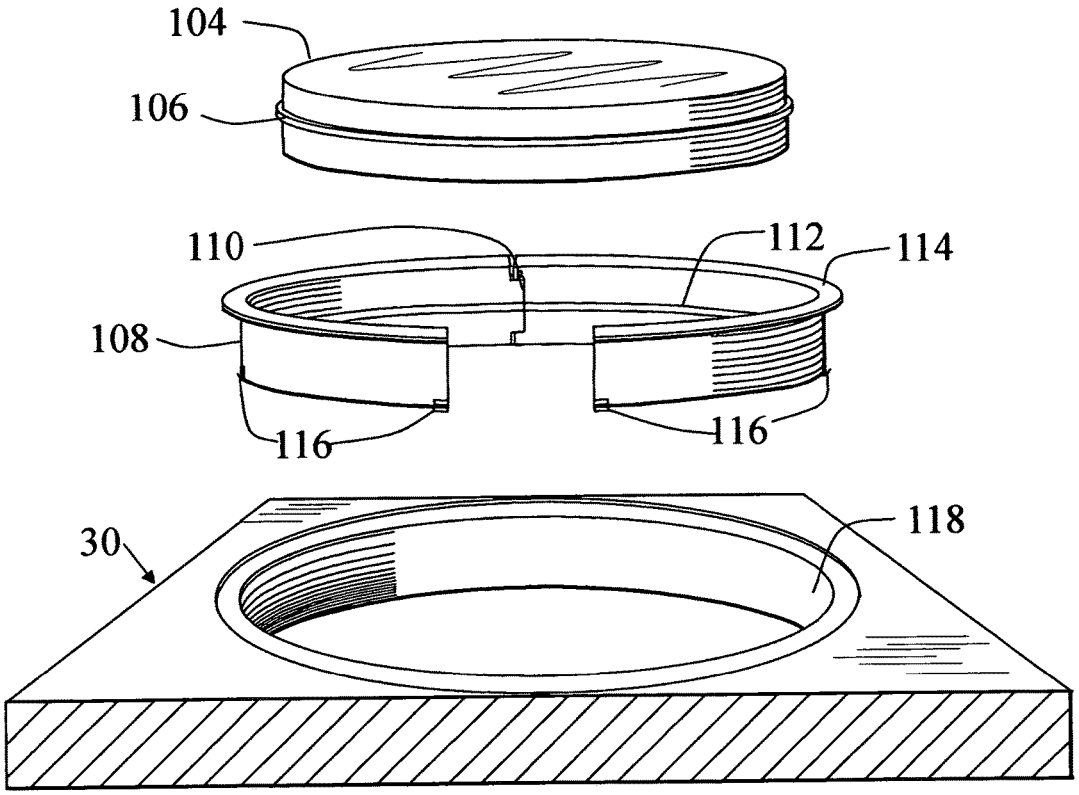
FIGS. 15C and 15D show the female side of the magnetic guides in the inverted (non-functioning) position.
Figure 15D:
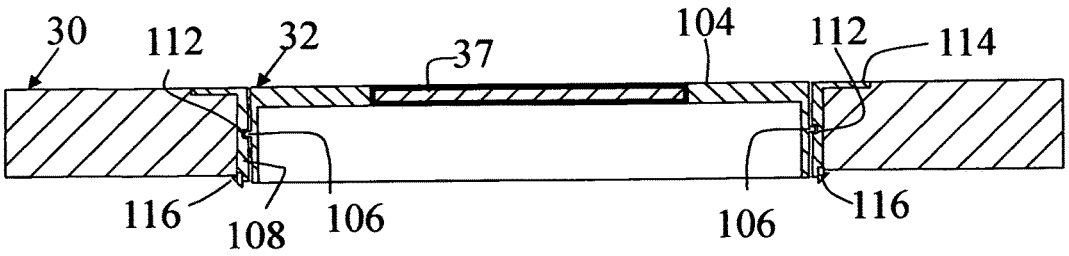
Figure 15E:
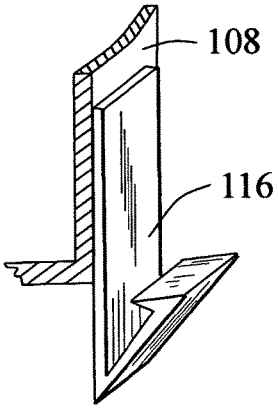
FIG. 15E is an expanded view of the quick-disconnect mechanism used on the female side of the magnetic guides.
Figure 16:
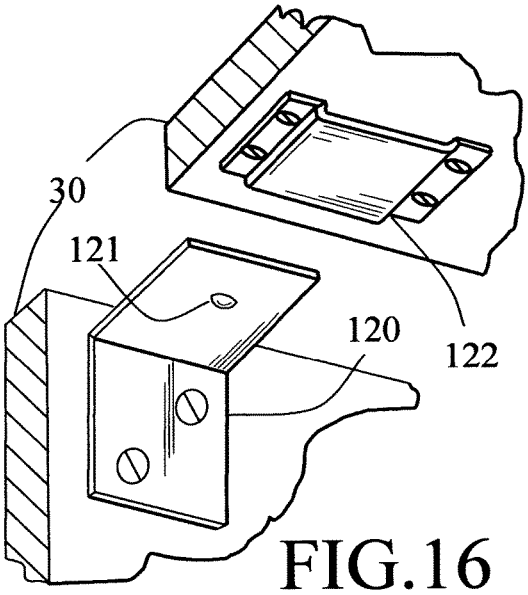
FIG. 16 is an expanded view of the assembly brackets.
Figure 17:
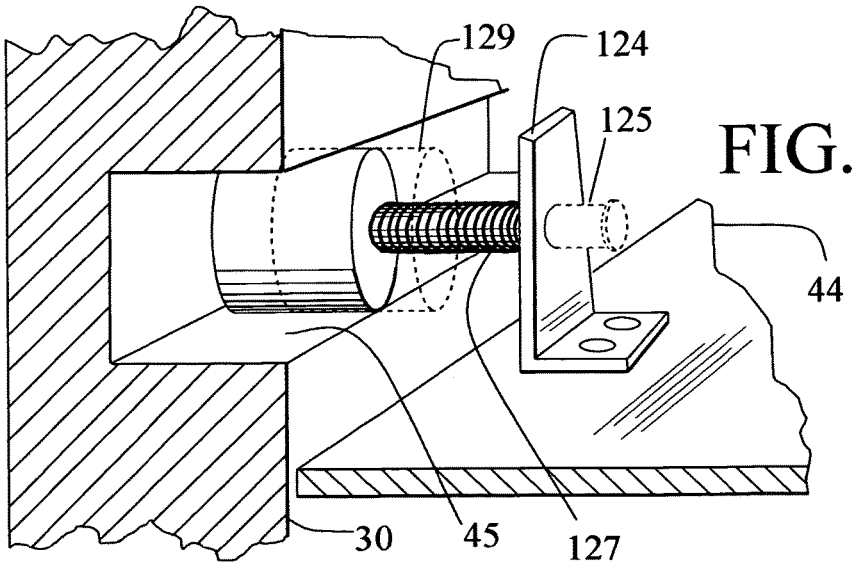
FIG. 17 is an expanded view of the door track system.
Figure 18:
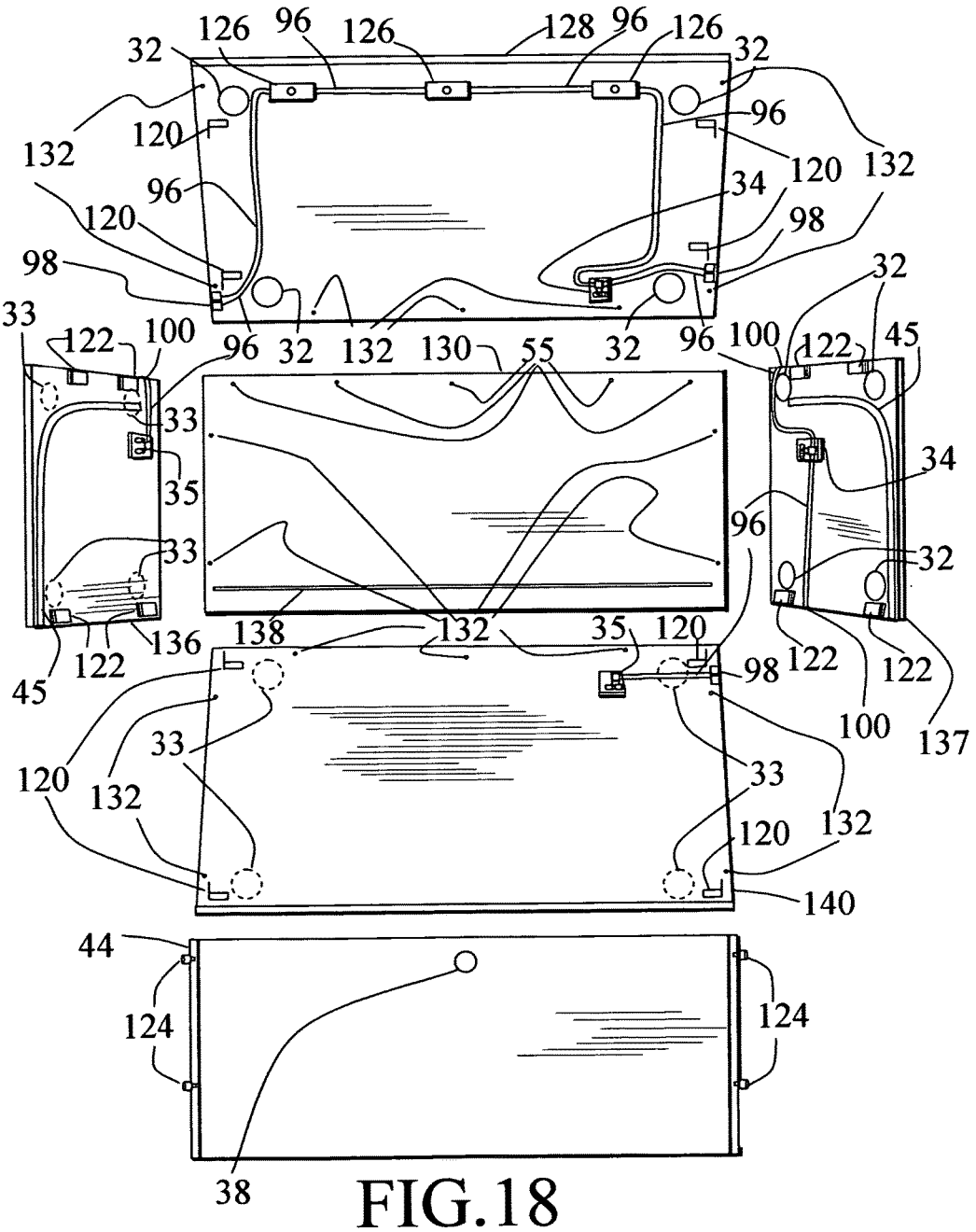
FIG. 18 shows the disassembled enclosure without the drawer.

One embodiment of the CapPalace enclosure 30 is illustrated in FIG. 1 (front view), FIG. 2A (front view with door closed), and FIG. 2B (front view with door open). FIG. 3 illustrates three enclosures wall mounted horizontally and FIG. 4 illustrates three enclosures in the stacked configuration. In an alternative embodiment a power supply which can only be operated by remote control is built into the base FIG. 6A, Thereby, eliminating the need for a power supply unit 64 on top of the stack.

The cap storage cabinet (CapPalace) 30 enclosure consists of four durable plastic or medium-density fiberboard (MDF) panels approximately one half inch in thickness in proper sizes to produce external dimensions of 27 inch Width by 12 inch Height by 13 inch Depth. The base 46 is one piece construction consisting of the same material as the enclosure measuring 27 inch width by 5 inch Height by 13 inch Depth.

The left panel 136 has two bolt lock receptors 122, a pressure electrical assembly 35, a two stranded insulated conductor tape 96, one insulation piercing contact 100, a door wheel channel 45, and four magnetic stacking guides (Male) 33. The right panel 137 has two bolt lock receptors 122, a flush electrical assembly 34, four magnetic stacking guides (Female) 32, two 2-stranded insulated conductor tape lengths 96, two insulation piercing contacts 100 and a door wheel channel 45. The top panel 128 has four magnetic stacking guides (Female) 32, three LED assemblies 126, five 2-stranded conductor tapes 96, two 2 wire tape surface contacts 98, four locking bolts 120, and a flush electrical assembly 34. The rear panel 130 has four screw holes 132, five bracket screw holes 55, and a drawer groove 138. The bottom panel 140 has four magnetic stacking guides (Male) 33, a pressure electrical assembly 35, a two stranded insulated conductor tape 96 and a two wire tape surface contact 98. The door 44 consists of a sheet of rigid transparent material measuring 25¾ inches by 11¾ inches with four door wheels 124 and a door handle 38.

Figure 19A:
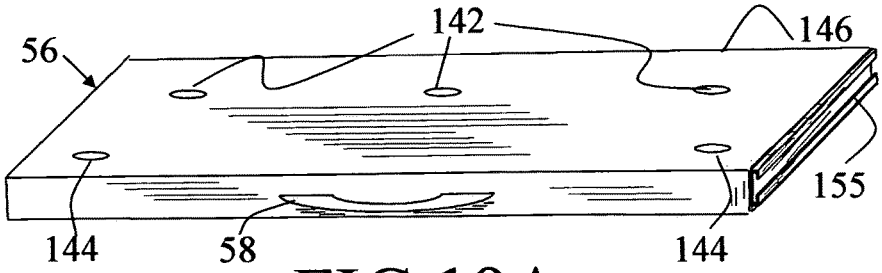
FIGS. 19A to 19C show different aspects of the drawer when completely assembled.
Figure 19B:
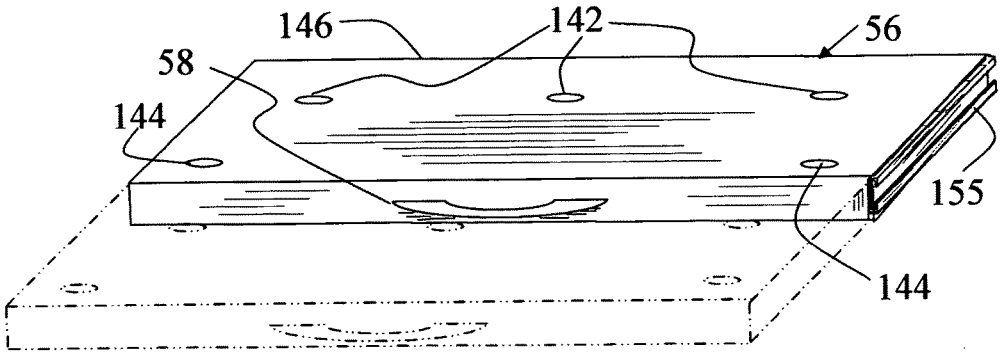
Figure 19C:
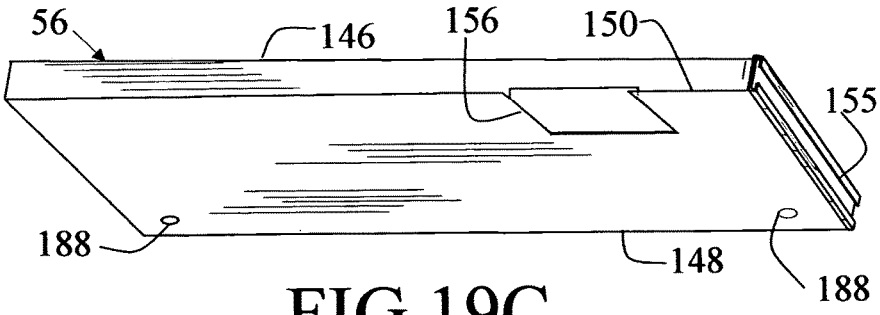
Figure 19D:
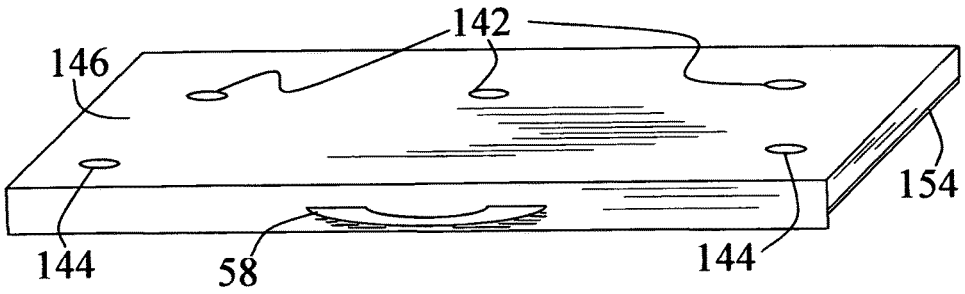
FIGS. 19D to 19F show different aspects of top and bottom portions of the drawer.
Figure 19E:
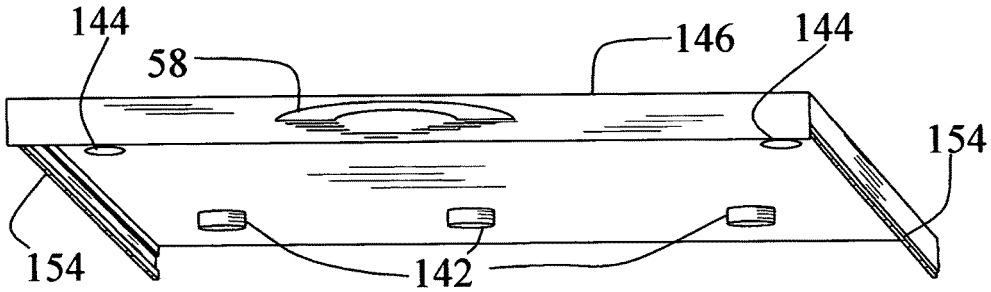
Figure 19F:
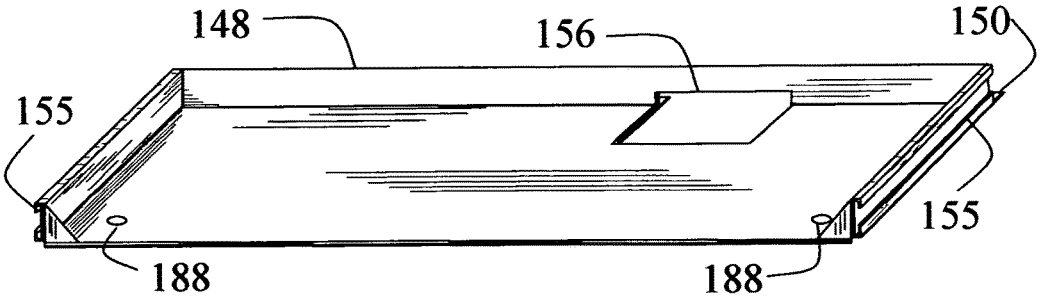

The top drawer assembly FIGS. 19A to 19F consists of one piece sheet metal approximately 25 inches wide and 11 inches deep with the front and sides formed downward approximately ¾ of an inch on the front and sides for structural strength and to provide surfaces to attach to the drawer rails (mounted on top drawer assembly) 154 FIG. 19F, and the drawer handle 58 FIG. 19D. Three head form screw holes 142 FIG. 19E are strategically placed on top of the drawer to allow each of the three head forms FIGS. 20A to 20C to accommodate a normal sized cap inside the enclosure without distorting the crown or the bill. The bottom drawer assembly FIG. 19F, a one piece sheet metal construction, is one inch wider than the top drawer assembly with the rear and sides formed upward approximately ¾ of an inch for structural strength and to provide surfaces to attach to the drawer rails (mounted on bottom drawer assembly) 155 on the sides. The bottom drawer assembly also has a four inch square electrical clearance opening 156 in the rear where the enclosure electrical pressure assembly 35 is located and a ¼ inch rear lip 150 extending across (with exception of the electrical clearance opening 156) the rear and bottom edge of the assembly.

The head forms FIGS. 20A to 24B consist of a resilient plastic approximately 10 inches tall approximating the shape and size of an average human head from the cheek bone area up. Externally the head form FIG. 22A consists of 8 head form segments 158 that are anchored to the Pivot Anchor Ring 164 at the bottom and an Elastic Band 85 at the top. The cap 172 which has a hat size scale 81 that is calibrated to hat sizes and an aperture 79 that shows a mark (line) corresponding to the hat size on the head form segment 158 below it, and a hexagonal opening (for Allen wrench) 47 that allows the user to adjust the head form FIG. 22A to the desired hat size. The bottom of the head form FIG. 22A has a threaded one inch in diameter plastic mounting screw 168. Internally, the head form FIG. 23A consists of a vertical worm screw shaft 176; a plastic ball 87 containing a threaded hole 179 extending vertically through center and two ball guide holes 181 one hundred and eighty degrees apart also extending in a vertical direction; and two ball guides 180 running vertically through the head form and ball. The worm screw shaft 176 is held in place by retainer ring 184 at the bottom and the cap 172 on top. The worm screw 178 portion of the worm screw shaft 176 runs through the center of the ball 87 which is threaded to match the worm screw 178. The two guide holes 93 which are offset from the center each accommodate a ball guide 180 that extends vertically through the head form and screw into ball guide screw holes 170 on the pivot anchor Ring 164 at the bottom of the head form 40 and are secured at the top of the head form by cap screws 41 that go through the guide holes 93 in the cap 172, thus also serving to secure the cap 172 in place. The ball guides 180 prevent the ball 87 from spinning free when the worm screw is turned. Thus forcing the ball 87 to raise or lower by releasing or adding pressure to the sloping surfaces 91 of the head form segments 158 as the hexagonal hat size adjustment 47 is turned. The head form segments 158 are shaped so that when the ball 87 is fully raised the head form segments 158 are fully retracted and when the ball 87 is fully lowered the head form segments 158 are fully extended FIGS. 24A to 24B.

Operation—FIGS. 1, 2, 3, 4, 5, 6, 7, 8, 9, 10, 11, 12, 13, 14, 15, 16, 17, 18, 19, 20, 21, 22, 23, 24

The preferred embodiment of the CapPalace enclosure FIG. 2A is designed for ease of assembly with special consideration for the least technical user. To this end, this embodiment incorporates low voltage lighting prewired panels with insulation piercing technology FIG. 18, magnetic stacking guides FIGS. 14 and 15 thru 15E, easily adjustable head forms FIGS. 20A to 24B, and minimize tool requirements to a flat blade screwdriver, a Phillips head screwdriver, and an Allen wrench.

To assemble a CapPalace enclosure first hand screw in the four Magnetic Stacking Guides (Male) 33 into the holes provided on the external side of the bottom panel 140 until snug. Then flip over and place the bottom panel 140 with the longer sides extending sideways on a horizontal surface with the locking bolts 120 pointing up and the pressure electrical assembly 35 farthest away. This will position the bottom panel 140 so that the front of the enclosure will be closest to the user. Next screw the four magnetic stacking guides (Male) 33 in the holes provided on the external side of the left panel 136 if desired. Then hold the left panel 136 vertically and aligned with the left edge of bottom panel 140. The locking bolt receptors 122 are located on the panels in configurations that only match the one set of locking bolts pertaining to them. Therefore, before lowering the left panel 136 on to the bottom panel 140 the user must ensure that both locking bolts 120 and the locking bolt receptors 122 are all properly aligned. If they do not align, ensure that the panel being installed is the correct one or that the panel is right side up. When the locking bolts 120 and locking bolt receptors 122 are properly aligned lower the panel engaging the locking bolts 120 and locking bolt receptors 122 and continue pressing the left panel 136 down until the detents 121 on the locking bolts 120 FIG. 16 snap in place. The right panel 137 is installed the same way as the left panel 136 above with the exception that before starting the installation decide whether the magnetic guide function will be needed on the left side if the answer is yes, assemble the female magnetic guide assembly FIGS. 15A and 15B by opening the magnetic guide retainer ring 108 (it is hinged 110) and placing it around the magnetic guide 104 with the magnetic guide retainer ring flange 114 on the open side of the magnetic guide 104 with the magnetic guide ridge 106 riding in the magnetic guide retainer ring groove 112 and sliding them into one of the magnetic guide holes 118 in the panel from the external side until the securing hooks 116 snap into place. If the magnetic guide will not be needed simply flip the magnetic guide 104 over so that magnetic guide retainer ring flange 114 is on the closed side of the magnetic guide 104 FIGS. 15C and 15D. Thus, if the female magnetic guides 32 FIG. 15D will not be needed, they should be externally flush with the panel. Repeat this procedure for the other 3 magnetic guide holes 118 in this panel. To install the top panel 128 first install the four female magnetic guide assemblies FIGS. 15A and 15B as discussed above then hold the top panel 128 horizontally with the long sides extending sideways and the LEDs 126 closest to the user, ensure that the locking bolts 120 on the top panel 128 and the locking bolt receptors 122 on the top of the left and right panels 136 and 137 align properly, and lower the top panel 128 on to the left and right panels 136 and 137 engaging all 4 locking bolts 120 with the locking bolt receptors 122, and continue pressing down until the detents 121 on the locking bolts 120 snap in place. To install the rear panel 130 place it on the long side of the CapPalace 30 that is farthest away from the LEDs 126 which are located on the top panel 128, ensuring that the drawer groove 138 is at the bottom of the rear panel 130 and facing toward the inside of the enclosure and temporarily keep it in place with the screws 52 that go into the side panels. Secure the top panel 128 to the left and right panels 136 and 137 with screws. The top panel 128 is prewired with wire tape surface contact 98 on the left side and one on the right side (that correspond to insulation piercing contact assemblies 100 at the tops of the left and right panels 136 and 137) in addition to three LEDs 126 and one flush electrical contact assembly 34. The left panel 136 is prewired with a pressure electrical assembly 35 and one insulation piercing contact assembly 100. The insulation piercing contact assemblies 100 penetrate the insulation of the wire tape surface contacts 98 at the tops of the left and right panels 136 and 137 creating electrical continuity between the panels as the screws 52 are torqued down pressing the panels together. To secure the bottom panel 140 to the side panels flip the enclosure 30 on its rear panel 130 to expose the bottom of the bottom panel 140. Put screws 52 in and tighten the bottom panel 140 to the left and right panels 136 and 137. The left panel 136 is prewired with a pressure electrical assembly 35 that is connected to a insulation piercing contact assembly 100 located at the top edge of the panel. The right panel 137 is prewired with a flush electrical contact assembly 34 that is connected to two insulation piercing contact assemblies 100—one located at the top edge of the panel and one located at the bottom edge of the panel. Electrical connections throughout the enclosure are made when the top and bottom panels 128 and 140 are fully screwed down to the left and right panels 136 and 137. To continue assembly of the enclosure 30, while the bottom panel 140 is exposed install and tighten the screws 52 for it. Flip the enclosure 30 to expose the rear panel 130 and install and tighten all the screws 52 for it. Flip the enclosure 30 one more time so that the top panel 128 is on top and install and tighten all the screws 52 for that panel. To install the drawer assembly 56, slide the drawer assembly 56 in until the rear lip 150 on the bottom rear edge of the drawer assembly 56 slides into the drawer groove 138 located in the rear panel 130. Then screw down the drawer assembly 56 to the bottom panel 140 through access holes 144 at the top front of the drawer assembly 56. To install the heads forms 40, first adjust the heads forms 40 to the desired hat size by turning the hexagonal opening (for Allen wrench) 47 at the top of the head forms 40 so that the Hat Size Indicator 80 lines up on the proper hat size on the hat size scale 81 and install the heads by screwing them into the head form screw holes 142 on top of the drawer assembly 56. To install the door 44, first put the top door wheels 124 in the door wheel channels 45 in the left and right side panels 136 and 137, by holding the door 44 so that the door handle 38 is at the bottom facing out, pressing and holding the spring loaded door wheels 124 in while placing them in the door wheel channels 45. Then sliding the door 44 up to get the bottom door wheels 124 close to the door wheel channels 45 in the left and right panels 136 and 137, pressing and holding the spring loaded bottom door wheels 124 while inserting them into the door wheel channels 45. Place the (CapPalace) 30 on top of the base 46 and the stackable power supply 64 on top of the enclosure and plug the stackable power supply 64 into the nearest AC outlet to complete the assembly. The electrical connections between the Stackable Power Supply 64 and the (CapPalace) 30 are achieved through the flush electrical contact assembly 34 located on the top of the cap storage cabinet (CapPalace) 30 and the pressure electrical assembly 35 located at the bottom of stackable power supply 64. The four magnetic stacking guides (Male) 33 located at the bottom of the stackable power supply 64 and the matching magnetic stacking guide (Female) 32 located at the top of the cap storage cabinet (CapPalace) 30 ensure a perfect alignment and strong adhesion of the units.

The stackable power supply 64 and the wall mountable power supply 60 do not require assembly as they are preassembled and ready for installation. Both power supplies 62 and 66 have manual and remote control capabilities FIG. 9D. If remote control operation is desired, batteries must be installed in the remote control FIG. 9D prior to operation. The alternative embodiment in which the power supply is built into the base FIG. 6A contains a Flush Electrical Contact Assembly 34 on top and only has remote control FIG. 9D capabilities, Blue Tooth capabilities or Smart Phone application capabilities.

It is my intent to incorporate as many items that are already available for purchase in the open market as possible into my embodiment. For that reason, the drawer rails 154 and 155, the internal circuitry of the power supplies FIGS. 8 and 9 and corresponding remote controls FIG. 9D, the LED 126 fixtures and the two stranded insulated conductor tape 96 are not shown in great detail in this embodiment.

To install the cap storage cabinet (CapPalace) 30 in a stacked configuration simply, assemble the individual enclosures as discussed above and starting with the base unit 46 place each CapPalace enclosure unit 30 on top of the other. The magnetic stacking guides 32 and 33 keep the units securely together and contact between the flush electrical contact assembly 34 FIG. 11 and pressure electrical assemblies 35 FIG. 12 provide the electrical connections between the individual units. The stackable power supply 64 can be placed anywhere in the stack and plugged into the nearest AC outlet. As stated earlier an alternative embodiment in which a remote control only power supply is built into the base FIG. 6A unit would eliminate the need for a stackable power supply 64.

To install the cap storage cabinet (CapPalace) 30 in a wall mounted configuration FIG. 3 assemble the individual enclosures 30 as discussed above. Then, install the wall mounting cabinet attachment 54 to the cap storage cabinet (CapPalace) 30 units by positioning the wall mounting cabinet attachment 54 externally on the upper end of rear panel 130 horizontally so that the surface with the five screw holes is at the top and flush against the rear panel 130, aligning the five screw holes with the screw holes 55 on the rear panel 130 and securing it using five screws 52. Install the wall mount frame 53 securely to the wall. Hang the cap storage cabinet (CapPalace) 30 units on the Wall Mount Frame 53 making sure that the units are pressed together to engage the magnetic guides 32 and 33 so that the pressure contacts 34 and 35 can establish electrical continuity. The wall mountable power supply 60 can be placed anywhere on the Wall Mount Frame 53 as long as at least one side abuts one of the cap storage cabinet (CapPalace) 30 units and plug into nearest AC outlet.

CONCLUSIONS, RAMIFICATIONS, AND SCOPE

Accordingly the reader will see that, according to one embodiment of the invention, I have provided a significant improvement over prior art pertaining to the storage and display of fitted fashionable baseball style caps, hats, turbines, wigs and other headwear and in alternative embodiments without head forms for the storage/display of sweaters, shoes or valuable collectibles, etc. This embodiment incorporates state-of-the-art technologies from various sources to produce an enclosure that is sold unassembled to economize in warehouse storage and shipping expenses but uses quick-disconnect technology, pressure and insulation piercing electrical contact technology and magnetic stacking guides for easy assembly and wall mounted or stacked installation in horizontal configuration. Additionally, this embodiment protects the contents from dust and dirt, has a plurality of adjustable head forms to ensure the integrity of fashionable caps' or hats' crowns, bills and brims, has low voltage multicolored lighting that can be controlled manually, by remote control, by blue tooth technology via smart phone applications or be synchronized to a stereo system, has a front cantilevered transparent door on door tracks or in an alternative embodiment a hinged transparent door for easy viewing of contents, and has a drawer for ease of access. Furthermore, this embodiment has the additional advantages in that it:

is designed to fit into any modern interior decor in numerous configurations thus freeing up precious closet space, can be manufactured in a variety of sizes and shapes as well as a variety of materials including wood, plastic, composition materials or metals, lets the user expand the system as his/her storage requirements increase, does not require special skills or knowledge from the user to successfully assemble and install the units, requires only a flat blade screwdriver, a Phillips head screwdriver, and an Allen wrench to assemble and install the units in a stacked configuration. A wall mounted installation would also require a hand drill and level.

While the above description contains many specifications, these should not be construed as limitations on the scope of any embodiment, but as exemplifications of the presently preferred embodiments thereof. Many other ramifications and variations are possible within the teachings of the various embodiments. For example, the intended contents may dictate larger or smaller dimensions, type of drawer used or no drawer, omission of head forms, or even the angle in which the units hang for a special wall mounted configuration, new technological advances in communications devices may make new wireless lighting controls possible, the door can be made of glass, plastic or any other transparent material and be hinged at the bottom or either side, the head forms can be made adjustable by a simple marked band over a spring loaded form or may be a partial head form (top part from the cheek bones up) instead of a full head form, the placement of the lights may be on a different place in the units, each unit's wall may have two diagonally placed magnetic guides instead of four as shown in this embodiment, etc.

Thus the scope of the invention should be determined by the appended claims and their legal equivalents, and not by the examples given.

I claim:

1. An article of furniture comprising a top wall and a bottom wall composed of rigid material of predetermined sizes of equal length and width, a left side wall and a right side wall composed of rigid material of predetermined sizes of equal height and width equal to the width of said top wall and said bottom wall, a rear wall composed of rigid material of predetermined sizes of height equal to said left wall and said right wall and equal in length to said top wall and said bottom wall, a sliding drawer and a front door composed of a rigid transparent material that opens in an outwardly direction sufficiently to allow said sliding drawer and its contents to slide outward unimpaired, the improvement wherein said article of furniture's said top wall, said bottom wall, said left wall, and said right wall each has a plurality of;

(a) externally placed stacking guides embedded with magnetic material to interlock and magnetically adhere with corresponding said stacking guides on other said articles of furniture when said articles of furniture are stacked or when said articles of furniture are placed together side by side, stacked on a bases or wall mounted configurations, (b) externally placed spring mounted electrical contacts internally wired to other said spring mounted contacts and low voltage lighting devices within said article of furniture and to make external contact with corresponding said spring mounted electrical contacts on other said articles of furniture when said articles of furniture are stacked or when said articles of furniture are placed together side by side, and (c) insulation piercing contacts comprising an insulated two stranded wire conductor terminal and an insulation piercing means for causing sharp projections to penetrate through the insulation of said insulated two stranded wire conductor to establish electrical contact wherein said top wall and said bottom wall have a plurality of said insulated two stranded wire conductor terminals or said insulation piercing means placed on the inside of said wall edges at point of parallel conjunction with said left wall and said right wall corresponding to the placement of said insulation piercing means or insulated two stranded wire conductor terminals on said edges of said walls, and a plurality of adjustable head forms each comprising a rigid but flexible ovate structure and an adjustable means for causing the circumference of said ovate structure to increase or decrease to fit any desired hat size and a securing means for mounting said ovate structure to said sliding drawer.

2. Stackable mountable headwear storage and display cabinet system with variable lighting comprising a top wall made of a sheet of rigid material, a bottom wall made of a sheet of rigid material, a left wall made of a sheet of rigid material, a right wall made of a sheet of rigid material, a rear wall made of a sheet of rigid material, and a front door made of a sheet of rigid transparent material, wherein the improvements are increased accessibility of contents with a drawer located internally with a plurality of head forms mounted on the upper surface of said drawer that accommodates any type of said headwear, keeps said headwear dust free and promotes the integrity and shape thereof, improves visibility of contents with the aid of variable lighting that is an easy to assemble prefabricated system comprising a plurality of internally located low voltage light sources, an external low voltage power means for providing power to said low voltage light source, and a plurality of insulation piercing means disposed on top and bottom ends of said left wall and said right wall for penetrating correspondingly disposed insulated two conductor tape on undersurface of said top wall and upper surface of said bottom wall to provide electrical continuity within each said stackable mountable headwear storage and display cabinet system with variable lighting unit, a plurality of spring loaded pressure electrical contact means for extending with sufficient force to make and hold electrical contact with corresponding flush mounted electrical plate contacts located externally on said top wall, said bottom wall, said left wall and said right wall to provide electrical continuity between said stackable mountable headwear storage and display cabinet system with variable lighting units, and a plurality of magnetic stacking guides located externally on said top wall, said bottom wall, said left wall, and said right wall to provide sufficient adhesion between said stackable mountable headwear storage and display cabinet system with variable lighting units to ensure a solid electrical connection between said spring loaded pressure electrical contacts and corresponding said flush mounted electrical plate contacts.

3. The stackable mountable headwear storage and display cabinet system with variable lighting of claim 2 further including said top wall and said bottom wall are of identical predetermined length and width, said left wall and said right wall are of identical predetermined length and width, said rear wall is of predetermined length equivalent to the length of said top wall and said bottom wall and predetermined width is equivalent to the width of said right wall and said left wall, and said front door is of predetermined length and width approximately equivalent to the length and width of said rear wall.

4. The stackable mountable headwear storage and display cabinet system with variable lighting of claim 3 further including a means for joining said left wall, said right wall, and said rear wall perpendicularly on disposed respective edges of under surface of said top wall and upper surface of said bottom wall to form a predetermined sized five sided enclosure having a front opening with a hinge joint attaching means for providing a pivotal point allowing said front door to swing from closed position to fully open position.

5. The stackable mountable headwear storage and display cabinet system with variable lighting of claim 2 further including the internal wiring comprising of;

(a) said top wall internally adhered said insulated two conductor tape connecting to disposed said low voltage lighting illumination devices, a plurality of said flush mounted electrical plate contacts, and terminating at disposed undersurface right and left edges, (b) said bottom wall internally adhered said insulated two conductor tape connecting to a plurality of said spring loaded pressure electrical contacts strategically disposed and terminating at disposed upper surface right and left edges, (c) said left wall, internally adhered said insulated two conductor tape connecting to a plurality of said spring loaded pressure electrical contacts strategically disposed and terminating at said insulation piercing means disposed on said top and said bottom ends thereof and, (d) said right wall, internally adhered said insulated two conductor tape connecting to a plurality of said flush mounted electrical plate contacts strategically disposed and terminating at said insulation piercing means disposed on said top and said bottom ends thereof.

6. The stackable mountable headwear storage and display cabinet system with variable lighting of claim 2 further including the automatic internal electrical connections that occur during assembly as plurality of said insulation piercing means disposed on said top and said bottom ends of said left wall and said right wall penetrate the insulation of correspondingly disposed said insulated two conductor tape terminated at said top wall undersurface and at said bottom wall upper surface making electrical continuity with said conductor tape wires as joining means of said top wall and said bottom wall to said left wall and said right wall for urging tighter union thereof.

7. The stackable mountable headwear storage and display cabinet system with variable lighting of claim 2 further including the external electrical connections comprising of;

(a) said external low voltage power means for providing a variably adjusted low voltage to cause the said variable lighting system to illuminate from a low dim level to full brightness level, (b) a plurality of said spring loaded pressure electrical contact means are disposed externally on said left wall and said bottom wall for providing sufficient extension and spring pressure against said flush mounted electrical plate contacts of correspondingly disposed externally on said right wall and said top wall of other said stackable mountable headwear storage and display cabinet system with variable lighting units to establish electrical continuity thereof when stacked or placed in side by side configuration.

8. The stackable mountable headwear storage and display cabinet system with variable lighting of claim 2 further including a magnetic material composition thereof resulting in a magnetic attraction between opposing said magnetic stacking guides on said stackable mountable headwear storage and display cabinet system with variable lighting units of sufficient strength to substantially and aggressively urge a superior electro-mechanical connection between said spring loaded pressure electrical means and corresponding said flush mounted electrical plates thereby causing a firm and consistent electrical connection for said variable lighting system and provide substantial structural strength and stability when said stackable mountable headwear storage and display cabinet system with variable lighting units are stacked or in side by side configuration.

9. The stackable mountable headwear storage and display cabinet system with variable lighting of claim 2, further including a firm but flexible oviform device with an adjustable means for increasing and decreasing the circumference of said head form to any hat size desired, and a mounting means for attaching said head form to said upper surface of said drawer at spaced locations so as to adequately accommodate said headwear while providing easy access to said contents when fully extended.

10. The stackable mountable headwear storage and display cabinet system with variable lighting of claim 2 further including mounting means for attaching said drawer to said upper surface of said bottom wall of said stackable mountable headwear storage and display cabinet system with variable lighting in a manner that allows the door to close completely when said drawer is fully retracted and full unimpeded extension of said drawer when said door is fully open.

* * * * *